US008181577B2

(12) United States Patent
Bounds

(10) Patent No.: US 8,181,577 B2
(45) Date of Patent: May 22, 2012

(54) RAIL TRAIN

(75) Inventor: Ivan E. Bounds, St. Joseph, MO (US)

(73) Assignee: Herzog Contracting Corp., St. Joseph, MO (US)

( * ) Notice: Subject to any disclaimer, the term of this patent is extended or adjusted under 35 U.S.C. 154(b) by 244 days.

(21) Appl. No.: 12/545,632

(22) Filed: Aug. 21, 2009

(65) Prior Publication Data

US 2011/0041721 A1 Feb. 24, 2011

(51) Int. Cl.
*E01B 29/16* (2006.01)

(52) U.S. Cl. ..... 104/2; 104/5

(58) Field of Classification Search ..... 104/2, 3, 104/5, 15

See application file for complete search history.

(56) References Cited

U.S. PATENT DOCUMENTS

| | | | | |
|---|---|---|---|---|
| 1,704,269 | A | 3/1929 | Wattmann | |
| 2,944,492 | A | 7/1960 | Clejan | |
| 2,951,601 | A | 9/1960 | Castoe | |
| 3,288,082 | A | 11/1966 | Brosnan | |
| 3,366,258 | A | 1/1968 | Cox | |
| 3,376,988 | A | 4/1968 | Klosk | |
| 3,465,687 | A | 9/1969 | Kerns | |
| 3,908,842 | A | 9/1975 | Place | |
| 4,077,590 | A | 3/1978 | Shorey | |
| 4,414,454 | A | 11/1983 | Zollinger | |
| 4,478,155 | A | 10/1984 | Cena et al. | |
| 4,947,760 | A | 8/1990 | Dawson et al. | |
| 5,129,327 | A | 7/1992 | Snead | |
| 5,195,436 | A | 3/1993 | Valditerra | |
| 5,197,389 | A | 3/1993 | Glomski et al. | |
| 5,297,482 | A | 3/1994 | Cleveland | |
| 5,630,365 | A | 5/1997 | Hertelendi | |
| 5,961,271 | A * | 10/1999 | Theurer et al. | 414/339 |
| 6,315,508 | B1 | 11/2001 | Nadon | |
| 6,695,553 | B1 | 2/2004 | Galbreath et al. | |
| 6,981,452 | B2 * | 1/2006 | Herzog et al. | 104/2 |
| 7,255,047 | B1 | 8/2007 | Coslovi et al. | |
| 7,350,467 | B2 | 4/2008 | Green et al. | |
| 7,765,935 | B2 * | 8/2010 | Bounds | 104/2 |
| 7,895,950 | B2 * | 3/2011 | Green et al. | 104/2 |
| 2003/0205162 | A1 | 11/2003 | Herzog et al. | |
| 2004/0261650 | A1 | 12/2004 | Al-Kaabi et al. | |
| 2005/0172849 | A1 * | 8/2005 | Herzog et al. | 104/2 |
| 2006/0219123 | A1 | 10/2006 | Theurer | |
| 2008/0141893 | A1 * | 6/2008 | Herzog et al. | 104/2 |

FOREIGN PATENT DOCUMENTS

| | | |
|---|---|---|
| CA | 2198784 | 5/2005 |
| DE | 3522918 | 4/1986 |
| DE | 4103255 | 6/1992 |
| EP | 0044819 | 1/1982 |
| GB | 2159558 | 12/1985 |

* cited by examiner

*Primary Examiner* — S. Joseph Morano
*Assistant Examiner* — Zachary Kuhfuss
(74) *Attorney, Agent, or Firm* — Erickson, Kernell, Derusseau & Kleypas, LLC

(57) ABSTRACT

A rail train for supporting multiple sticks of ribbon rail comprises a plurality of rail support cars having a single, centrally positioned rail support stand wherein adjacent rail support cars are supported on shared trucks. End cars include a tunnel for supporting the rails near their ends and one or more rail support arms pivotal at a first end about two axis and supporting a rail guide assembly at a second end for supporting a rail as it is pulled of the rail train. A rail tie-down car utilizes spring-loaded, hydraulically actuated clamp assemblies to clamp individual rails to the tie-down car. Each clamp assembly incorporates at least two clamp members which act opposite one another to prevent the rail secured in place by the clamps from sliding in either longitudinal direction.

15 Claims, 24 Drawing Sheets

RAIL TRAIN

BACKGROUND OF THE INVENTION

1. Field of the Invention

This invention relates to trains for carrying railroad rails, and in particular trains for carrying long lengths of ribbon rail.

2. Description of the Related Art

Modern railroad tracks are constructed using long sections of ribbon rail which presently may be up to 1600 feet in length. These sections of ribbon rail are formed by butt welding multiple sticks of rail, which traditionally come from the steel mill in thirty-nine foot or seventy-eight foot lengths. The welding of the ribbon rails is done at a welding plant and the welded ribbon rails are transported to their installation site on a specially constructed rail train. When existing track is being replaced, ribbon rails may be unloaded from the rail train using a rail unloading machine, such as the Rail unloading machines disclosed in U.S. Pat. No. 6,981,452 and U.S. Patent Application Publication No. 2008/0141893, both to Herzog et al. The rail unloading machine pulls one or two rails off of the rail train as the rail train moves down the existing track and lays it alongside the existing rails.

Prior art rail trains traditionally comprise of a plurality of 60 foot flatcars connected together by standard railroad couplers. Each car includes a pair of transverse stands for supporting the ribbon rail. The stands of each car are spaced 30 feet apart and 15 feet from the respective coupler such that the stands are spaced 30 feet apart along the length of the rail train. The stands each include multiple tiers (typically five or six tiers) which each support a plurality of rails (for example eight to twelve rails per tier). The stands must each be strong enough both to support the weight of the rails and to resist side loads created by flexing of the ribbon rails as the rail train traverses curves in the track. Thirty foot spacing for the stands is believed to be optimal for supporting the rails without excessive sagging.

One car in each rail train is a tie-down car including a specialized stand which includes means for fixing the rails to the racks to prevent longitudinal movement of the rails relative to the tie-down car. The fixing means generally includes a plurality of clamping blocks which are bolted to the stand on opposite sides of each rail so as to bear against the foot or base flange of the rail and clamp it against the stand. Typically each clamping block is held down by three or four large bolts which must be installed or removed using an impact wrench or the like. All the other racks in the train allow for relative longitudinal movement of the rails and may include rollers which support the rails. This relative movement between the racks and the rails is required in order to allow the rails to flex without stretching or compressing as the train traverses curves in the track, as well as to allow for coupler slack that exists in each of the couplers between cars. Each coupler has up to approximately 6 inches of slack. Coupler slack and thermal expansion and contraction of the ribbon rail, generally necessitates that the tie-down car be positioned near the center of the rail train so as to evenly divide the rails and to thereby insure that neither the forward end nor the rearward end of the rail can move, expand or contract a sufficient distance relative to the nearest adjacent rack that the end of the rail falls off of the rack.

An end car, through which rails are loaded and unloaded, is positioned at the rearward end of the rail train. To unload rails from the rail train a rail unloading machine is coupled to the end car and pulls the rails from the end car. The end car includes a single stand or tunnel to support the ends of the rails and a barrier door rearward of the stand which swings inwardly across the car and acts as a stop to prevent the rails from sliding rearwardly off the rail train should one or more rails come loose from the tie-down car. End cars also typically include a ramp which is pivotally mounted to the deck of the end car rearward of the swing door. The ramp includes a roller on its distal end. The distal end of the ramp can be raised or lowered relative to the deck of the end car and is used to guide the rails upwardly or downwardly as they are being unloaded. An end car with barrier doors may also be located at the front end of the rail train to prevent the rails from sliding forwardly off the rail train should one or more rails come loose from the tie-down car.

A basic problem with existing rail trains is that the design of the cars does not allow the rails to flex evenly as the train traverses a curve. Having two stands per car isolates the portion of the rails located between the stands and holds it in a rigid orientation. Flexion of the rails is then concentrated into the sections located over the couplers. This uneven flexion of the rails causes increased side loads on the stands, as well as stress on the trucks and couplers. What is needed is an improved rail train which preserves optimal spacing of the stands but which allows for uniform flexing of the rails.

Worker safety is further endangered by the need to manually clamp and unclamp the rails using an impact wrench or the like. A clamping mechanism that could be remotely operated would greatly improve the safety of rail loading and unloading operations.

A further problem with prior art rail trains is the limited usefulness of the end car ramp for maneuvering rail. The ramp can support the rail during unloading and can raise and lower the rail within a limited range, but it cannot maneuver the rail inwardly or outwardly. Furthermore, the ramp cannot support a rail in an upright position during unloading and there is a danger of the rail tipping over. Most manipulation of the rail, including all inward and outward movement of the rail, must be performed by the rail unloading machine. The rail unloading machine includes feed boxes for pulling the rail and a crane for grasping and manipulating the rail into the feed boxes. Unloading of rail would be greatly simplified if the end car included improved means for manipulating the rail which could assist with feeding the ends of the rail into the feed boxes on the rail unloading machine.

SUMMARY OF THE INVENTION

The present invention is a rail train for transporting ribbon rail. Individual rail support cars in the train are each 30 feet in length and adjacent rail support cars are supported on shared trucks wherein each truck supports the rear of one car and the front of the adjacent car. The shared trucks have no couplers, and thus no coupler slack is created. Because of the lack of coupler slack, a tie-down car can be located anywhere in the train including adjacent to the end car where the rails will be unloaded. Each 30 foot rail support car only carries one stand or rack for supporting the rails. This maintains the preferred 30 foot spacing for supporting the rails, but allows the entire rail to bend as the train rounds curves, thereby minimizing the side loads.

The tie down car utilizes a respective hydraulically actuated, spring tensioned clamp for locking each rail section to the stand. Each clamp includes a base plate which fastens to the stand of the tie down car. The base plate has four openings formed therethrough, two on each side of the respective rail section. Respective clamping members extend upwardly through the openings. Each clamping member has a clamping flange which selectively engages a lower flange of the rail section. Each clamping member further includes a tubular guide which rides on a guide rod mounted to the underside of the base plate. The guide rods are mounted at an angle to the plate and respective wedges are mounted to the underside of the base plate above the tubular guides such that the guides ride against the wedges. Respective opposed pairs of the clamping members are positioned on each side of the rail section such that the thicker portions of the wedges are oriented toward one another. A tension spring pulls the two clamping members toward one another and against the wedges. Double acting hydraulic actuators selectively act on the clamping members to urge the clamping members out of clamping engagement with the rail and in opposition to the spring or to draw the clamping members back into clamping engagement with the rail. The spring acting on the adjacent clamping members, draws and holds the clamping members in clamping engagement with the rail when hydraulic pressure to the actuators is released, such as during transport of the rails.

On the end car of the rail train, the traditional unloading ramp is replaced by a pair of manipulating arms, each of which carries a guide box for grasping the rail. Each arm is mounted in a pocket below the deck of the end car and rearward of the last rack supporting the ribbon rail. The arms are retractable into the pockets and raise out of the pocket for use. The arms are independently operable and can maneuver the rails both vertically and laterally. This allows for more accurate feeding of the rails into the feed boxes of the unloading machine.

Each arm includes a rotatable base which allows the arm to rotate relative to the bed of the end car. Pivotally attached to the base are upper and lower parallel links, which are in turn pivotally connected to a guide box base. Each guide box is rotatably mounted on the respective guide box base. Each guide box includes jaws which open to admit the rail and then close or clamp around the rail. Idler rollers are provided in the clamp to allow smooth movement as the rail is pulled through the clamp (by the crane or by the unloading machine). All of the movements of the arms and guide roller boxes are achieved by respective hydraulic actuators which can be remotely controlled by an operator. The control equipment may be positioned in a control cab on the rail train or on the rail unloader. Alternatively, an operator may carry a hand held control unit and walk along side the end car to permit relatively close visual observation of the rail unloading process from the end car.

DETAILED DESCRIPTION OF THE PREFERRED EMBODIMENTS

Figure 1:
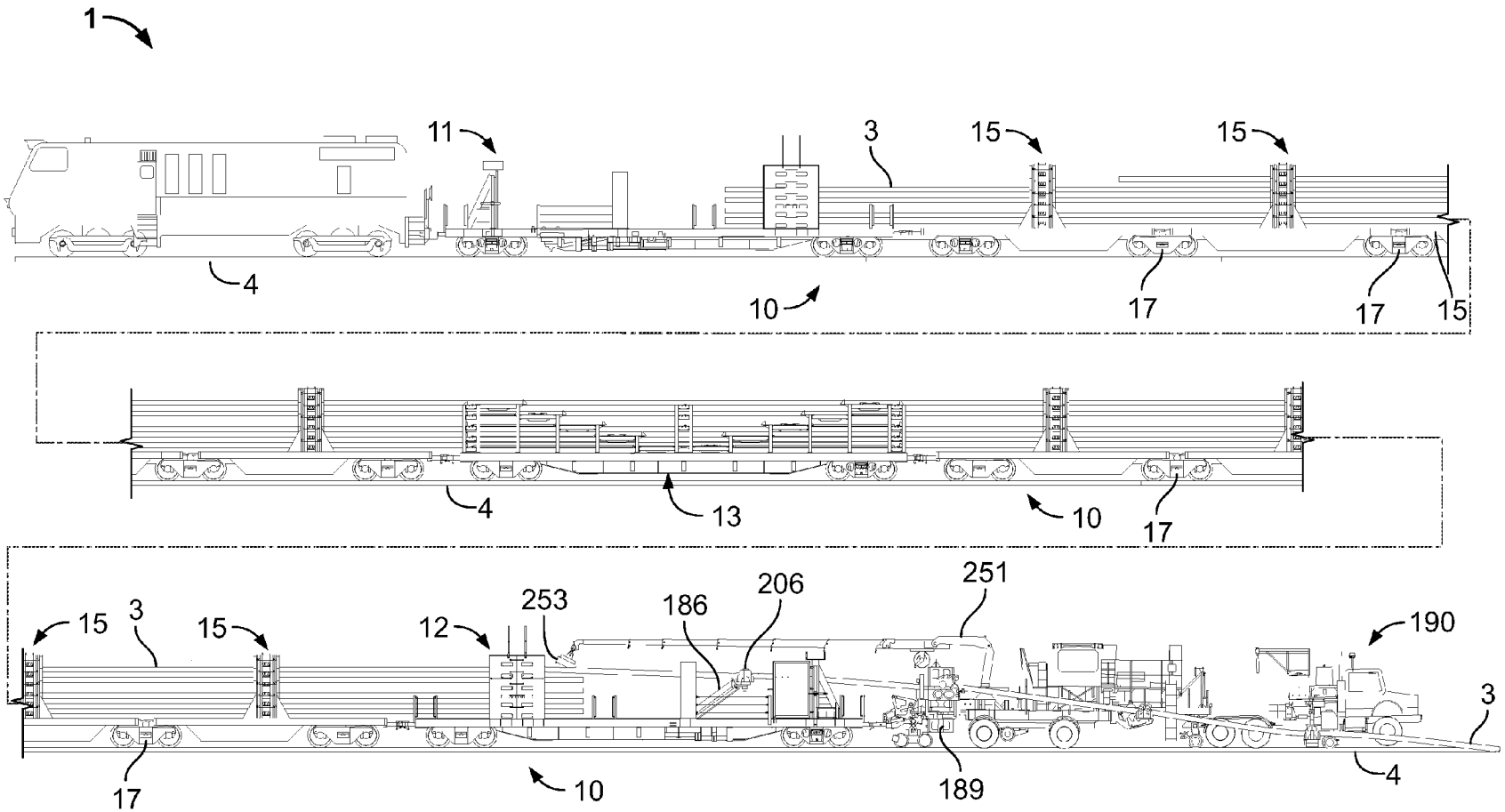
FIG. 1 is a partially schematic side view of a rail train having end cars at either end, a tie down car near the middle and a plurality of rail support cars for supporting multiple ribbon rails thereon.
Figure 2:
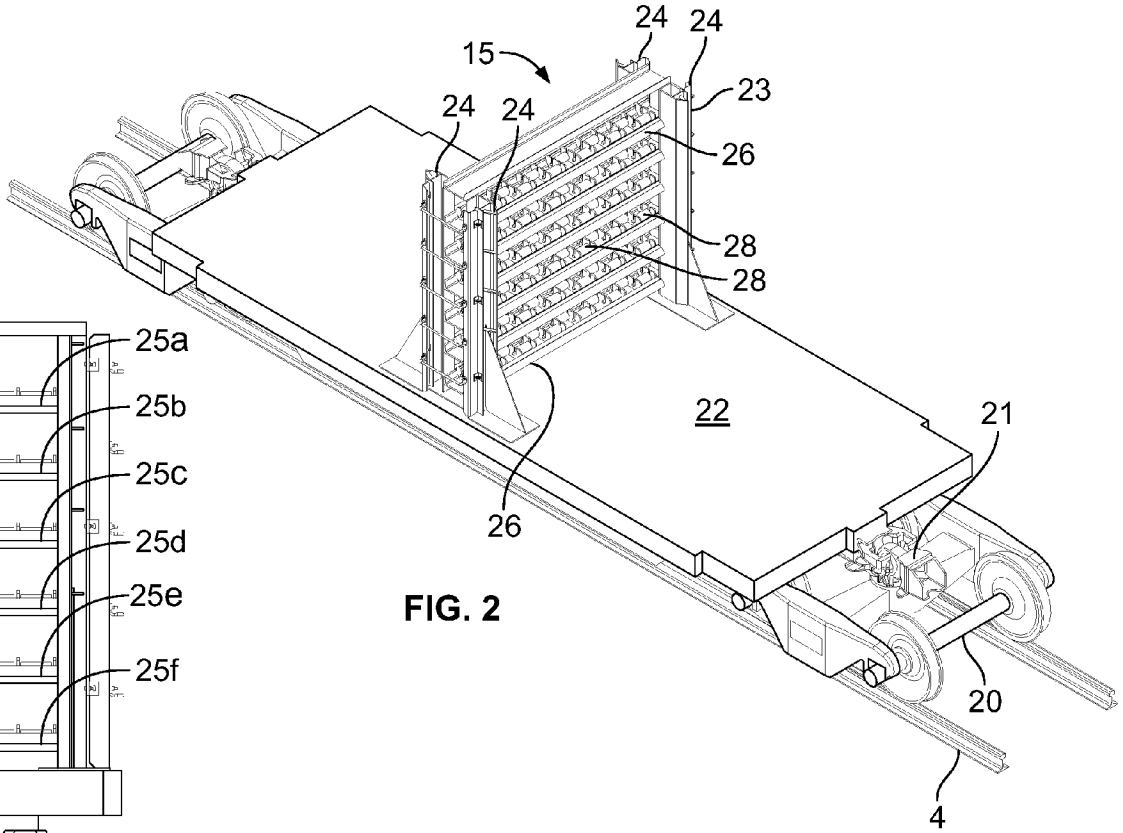
FIG. 2 is a perspective view of a rail support car incorporating shared trucks.
Figure 5:
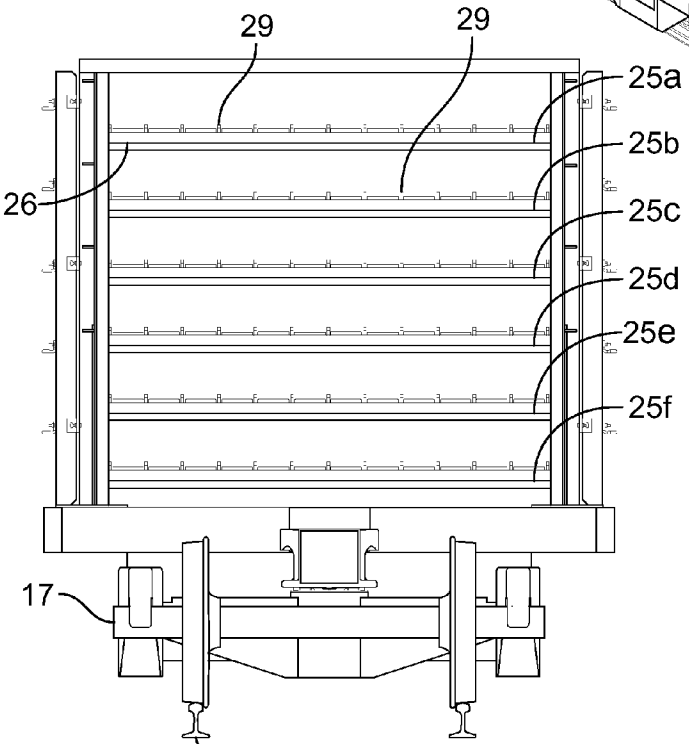
FIG. 5 is an end view of a rail support car as shown in FIG. 2.
Figure 3:
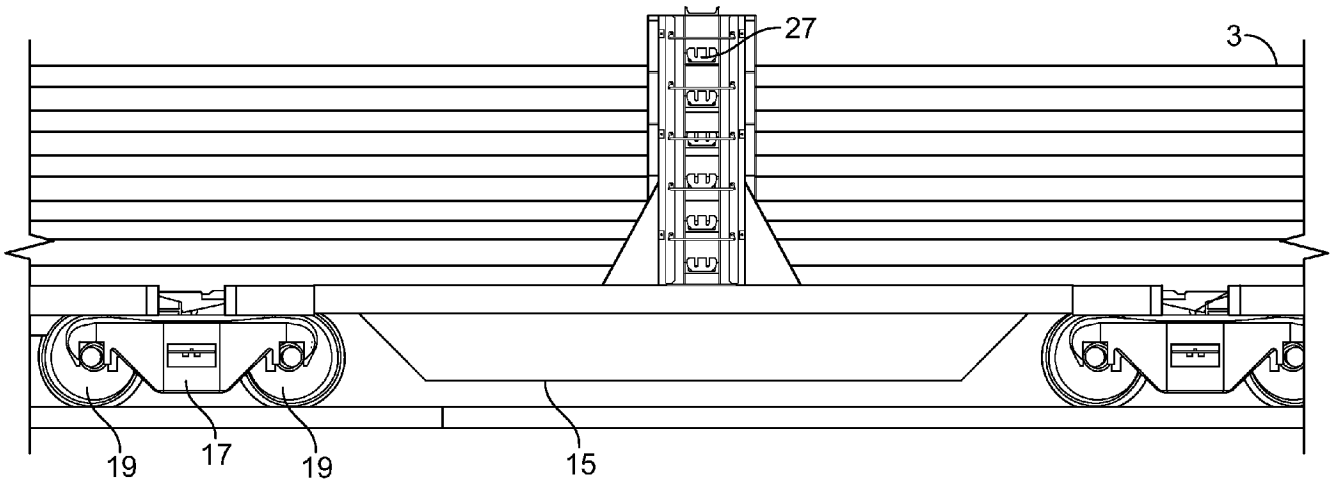
FIG. 3 is an enlarged and fragmentary side elevational view of a plurality of rail support cars supported on shared trucks with a pair of rails shown supported thereon.
Figure 4:
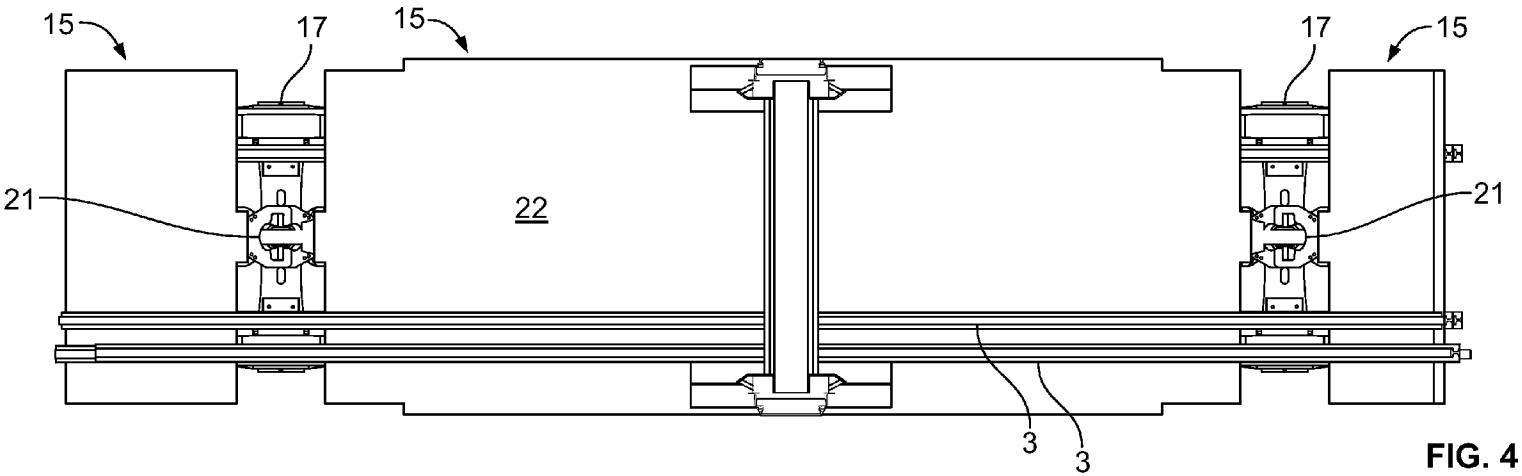
FIG. 4 is an enlarged and fragmentary top plan view of the rail support cars supported on shared trucks with three rails shown supported thereon.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. The drawings constitute a part of this specification and include exemplary embodiments of the present invention and illustrate various objects and features thereof.

Certain terminology will be used in the following description for convenience in reference only and will not be limiting. For example, the words "upwardly," "downwardly," "rightwardly," and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

Figure 13:
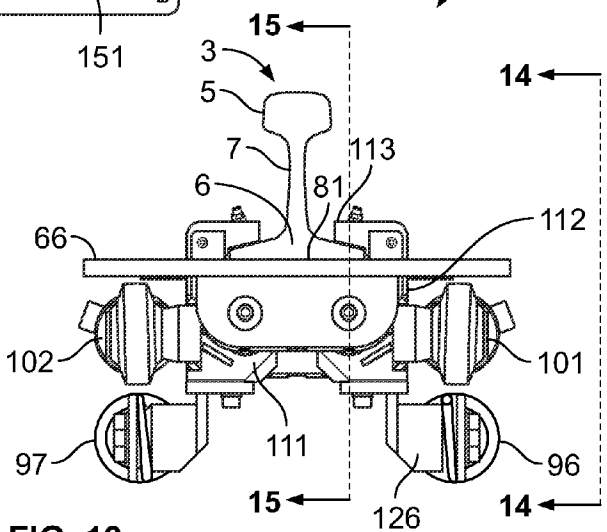
FIG. 13 is an end view of the clamping assembly with a fragmentary section of rail clamped thereto.
Figure 14:
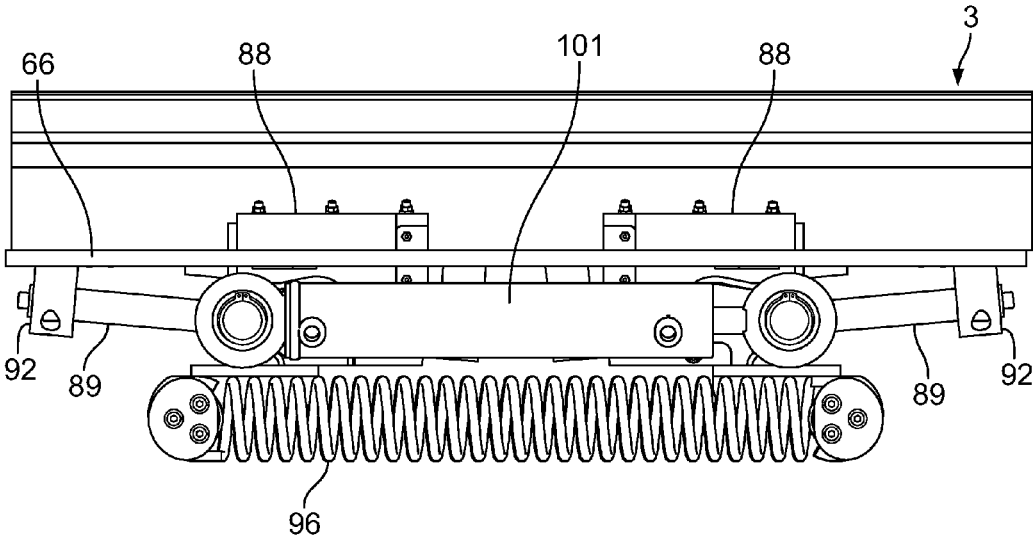
FIG. 14 is a side elevational view of the clamping assembly with a fragmentary section of rail clamped thereto viewed generally along line 14-14 of FIG. 13.
Figure 17:
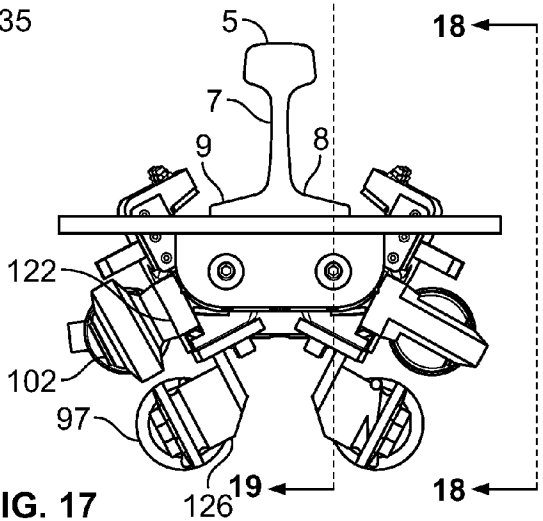
FIG. 17 is an end view of the clamping assembly in an unclamped alignment with a fragmentary section of rail supported thereon.
Figure 18:
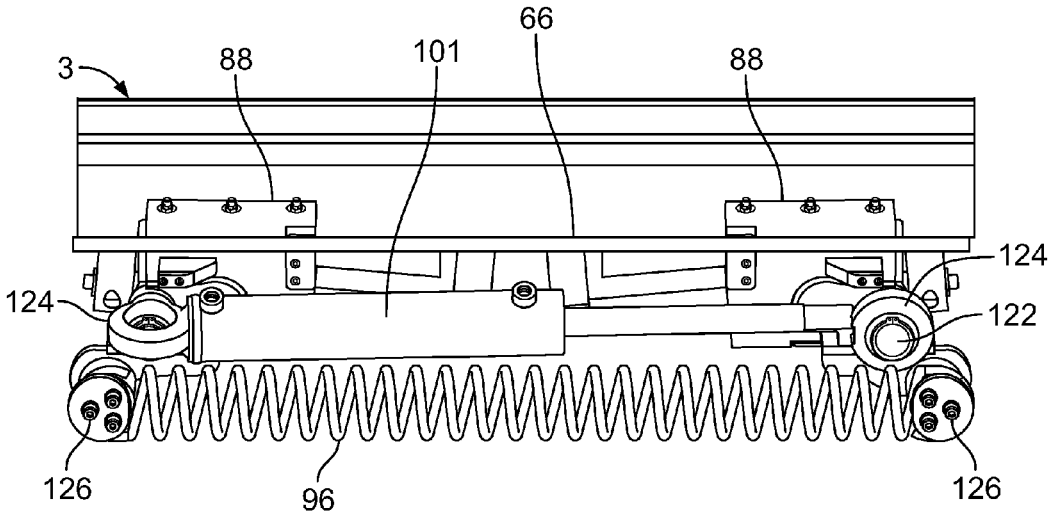
FIG. 18 is a side elevational view of the clamping assembly in an unclamped alignment with a fragmentary section of rail supported thereon viewed generally along line 18-18 of FIG. 17.

Referring to the drawings in more detail, the reference number 1 generally designates a rail train according to the present invention. The train 1 is adapted for transporting a plurality of ribbon rails 3 along a railroad track 4. Each rail 3, see FIGS. 13 and 17, includes a head 5, a base flange 6 and a web 7 connecting the base flange 6 to the head 5. The base flange 6 may be described as including opposingly directed feet 8 and 9. Referring to FIG. 1, the rail train 1 is made up of a plurality of cars 10, including front and rear end cars or tunnel cars 11 and 12, a tie-down car 13 and a plurality of rail support cars 15. The train 1 is pulled along the track 4 by one or more locomotives (not shown). In the embodiment shown, the tie-down car 13 is preferably positioned near the center of the train 1 to accommodate the greatest amount of expansion of the outer periphery of the train 1 as it rounds corners without pulling the fixed length rails 3 off of rail support shelves on the front and rear end cars 11 and 12.

Most of the rail support cars 15 are supported on shared bogies or trucks 17 which support both the front of one car 15 and the rear of an adjacent car 15. Shared trucks 17 may also be referred to as Jacobs bogies. The front and rear end cars 11 and 12 may or may not be supported on a shared truck 17 with the immediately adjacent car 15. In the embodiment shown in FIG. 1, the end cars 11 and 12 do not incorporate shared trucks and the immediately adjacent cars 15 have an individual truck adjacent the end car 11 or 12 and incorporate a shared truck at an opposite end. Similarly, the tie-down car 13 is not supported on shared trucks 17 so that the ends of the cars 10 adjacent the tie-down car 13 are not supported on shared trucks.

Referring to FIGS. 2-5, each of the shared trucks 17 includes two pairs of wheels 19 mounted on spaced apart axles 20. Adjacent rail cars 15 are connected to a common pivot assembly 21 mounted on the shared truck 17 between the axles 20 which allows both cars to pivot laterally relative to one another and the shared truck 17 as the train 1 traverses curves in the track. The pivot assembly 21 also allows the adjacent rail cars 15 to pivot side to side and fore and aft relative to the shared truck 17 and relative to one another.

Each of the regular rail support cars 15 is preferably thirty feet in length, measured between the centers of the shared trucks 17 at opposite ends of the car 15, and includes a deck 22 and a single rail support stand 23 which extends upwardly above the deck 22. Each stand 23 is preferably positioned at or near the center of the respective car 15 and extends transversely across the width of the car 15. Because the stands 23 are positioned in the center of each car 15 and the cars are thirty feet in length between the centers of the shared trucks 17, the spacing between adjacent stands is approximately thirty feet.

Each stand 23 includes two pairs of upright members or posts 24 and a plurality of shelves or tiers 25*a-f* which extend between the posts 24. Each shelf 25*a-f* is formed by cross-members 26 extending between pairs of posts 24 on opposite sides of the car 15, roller support members or plates 27 extending between the cross-members 26, and a plurality of rollers 28, each rotatably mounted between roller support plates 27. Each roller 28 rotates on a longitudinal axis extending across the width of the car 15. Each roller 28 is sized to receive the base flange or foot 7 of a respective one of the ribbon rails 3. Each roller 28 may include flanges 29 projecting outward from the ends of each roller 28 to hold each rail 3 is a specific alignment with respect to an associated roller 28. It is to be understood that more than one roller could be used to support a single rail 3.

In the embodiment shown in FIGS. 2-5, each rail support stand 23 includes six shelves 25 and twelve rollers 28 per shelf 25 to support up to seventy two rails 3 thereon in what is often referred to as separate pockets defined by each roller 28. It is to be understood that the number of shelves and the number of rollers or pockets formed per shelf could be modified. However, due to height considerations, six shelves is generally considered an optimum number of shelves. The number of rollers or pockets typically ranges between eight to twelve. As will be discussed in more detail below, the number of pockets and shelves 25 usually corresponds to the number of pockets and shelves on the tie-down car 13 and the end cars 11 and 12 will also typically have the same number of shelves and accommodate the same number of rails on each shelf. However, the embodiments of the rail support cars 15, tie-down car 13 and end cars 11 and 12 shown herein do not have matching numbers of pockets or shelves which shows some of the variations that might be utilized. The single rail support stand 23 on each rail support car 15 comprises the only structure on each of the rail support cars 15 providing vertical support for and lateral restraint of the plurality of ribbon rails 3 supported thereon.

Figure 6:
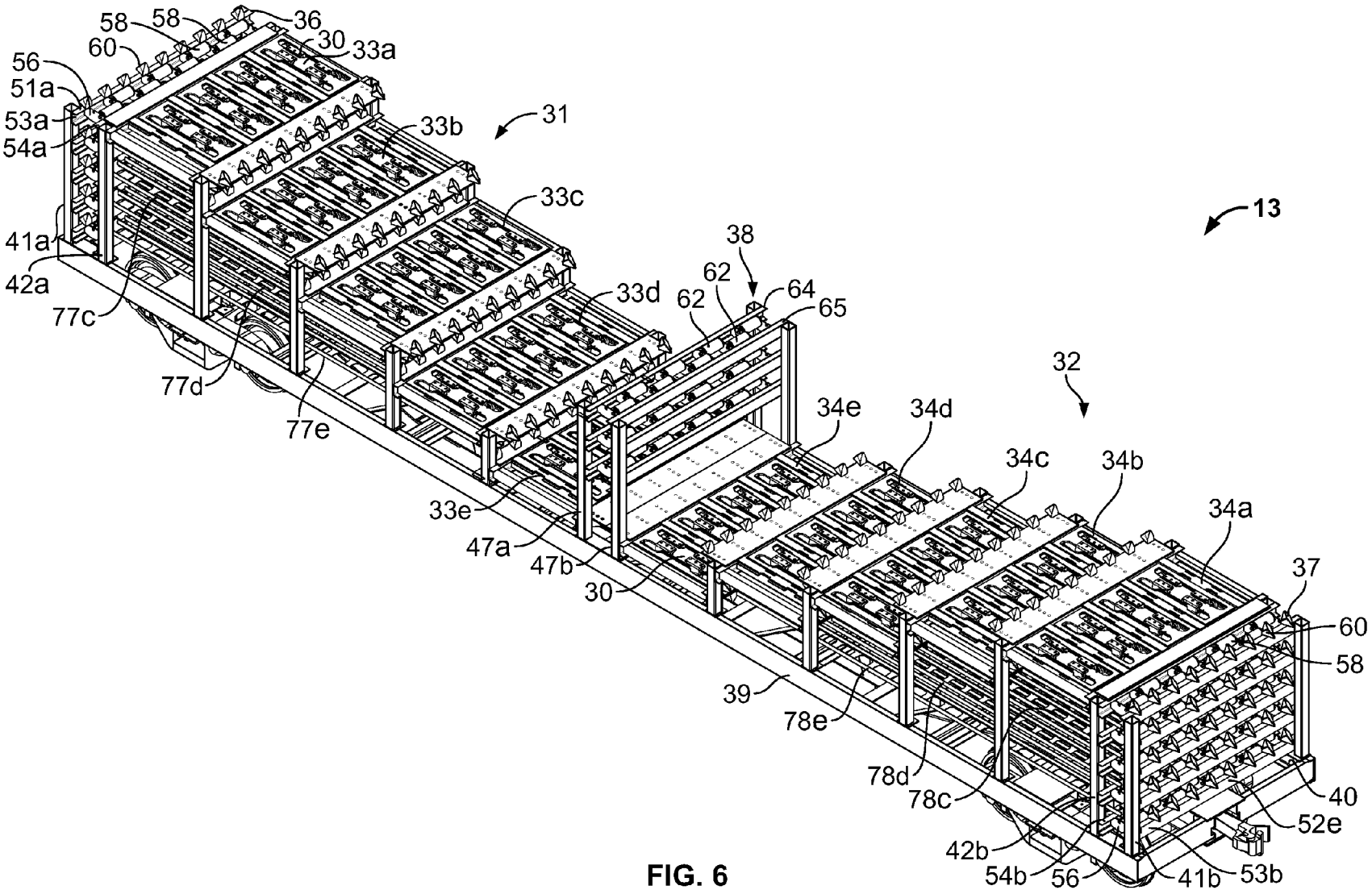
FIG. 6 is a perspective view of a rail tie-down car of the rail train as shown in FIG. 1.
Figure 7:
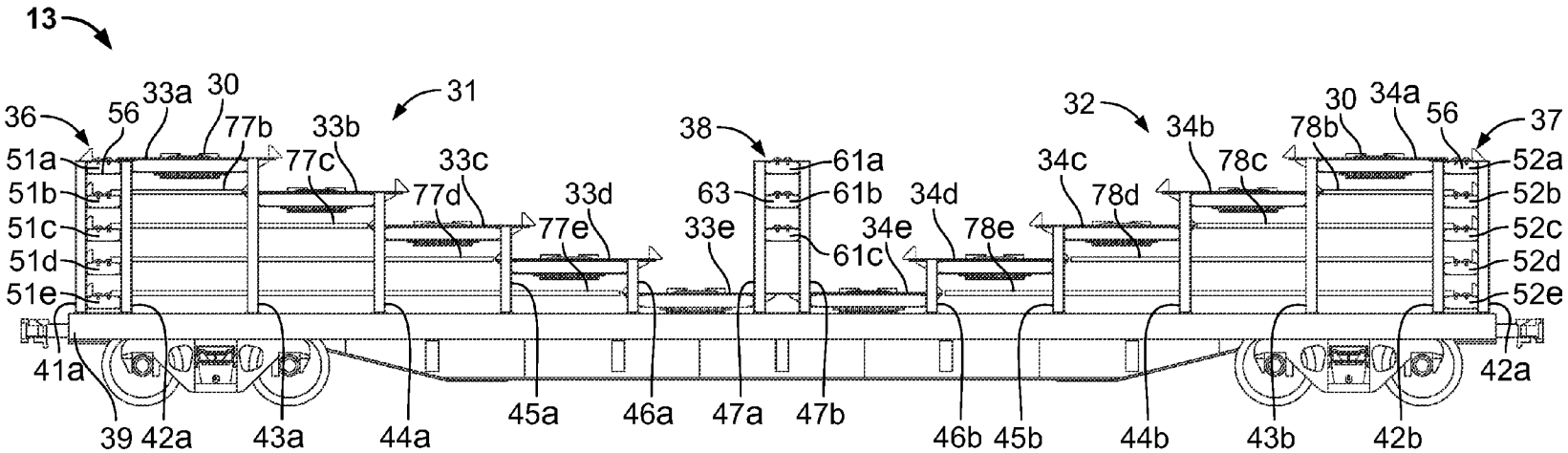
FIG. 7 is a side elevational view of the rail tie-down car including a plurality of shelves each supporting a plurality of clamp assemblies.
Figure 8:
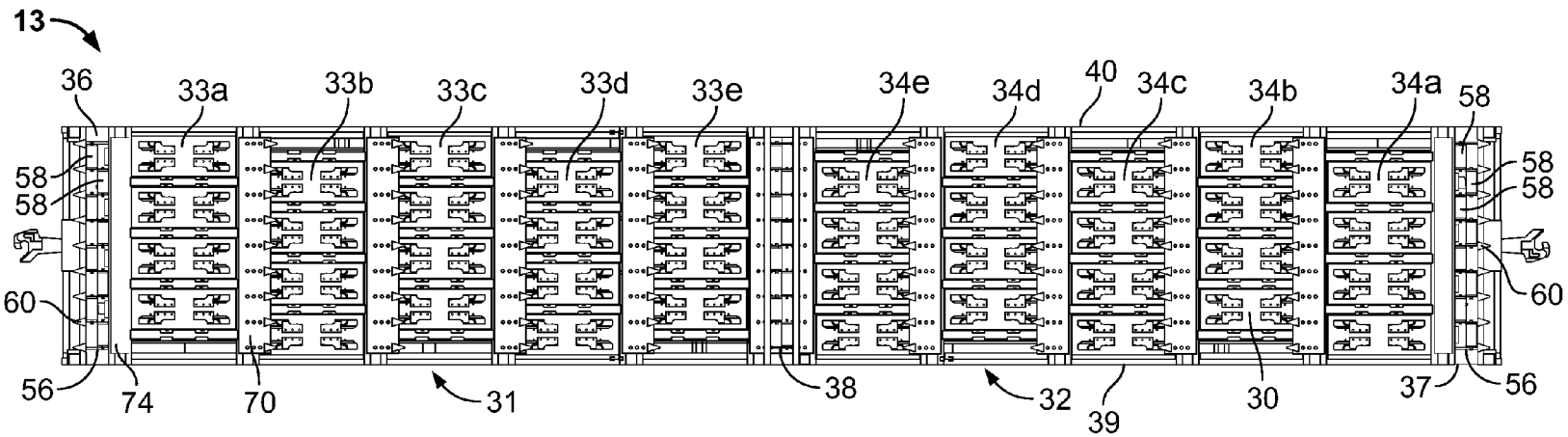
FIG. 8 is a top plan view of the rail tie-down car.

Referring to FIGS. 6-8, the tie-down car 13 includes a plurality of primary clamp assemblies 30 mounted on clamp stands 31 and 32. The clamp assemblies 30 clamp the ribbon rails 3 to the clamp stands 31 and 32 and to the train 1. The clamp stands 31 and 32 are generally mirror images with clamping assemblies 30 on clamp stand 31 connecting a first half of the rails 3 to the tie-down car 13 and clamping assemblies 30 on clamp stand 32 connecting a second half of the rails 3 to the tie-down car 13. As discussed in more detail hereafter, the primary clamp assemblies 30 are preferably hydraulically and remotely operated for clamping the ribbon rails 3 to the clamp stands 31 and 32. As mentioned elsewhere, it is to be understood that the clamp assemblies could be actuated pneumatically, electrically or mechanically.

Each clamp stand 31 and 32 includes a plurality of clamping shelves 33 and 34 respectively, corresponding to the number of layers or rows of rail 3 to be supported. In the embodiment shown, each stand 31 and 32 includes five shelves, shelves 33*a-e* on stand 31 and shelves 34*a-e* on stand 32. First and second end roller rack stands 36 and 37 are positioned adjacent and outwardly from clamp stands 31 and 32 respectively on the ends of the tie-down car 13. A center roller rack stand 38 is positioned in the center of the tie-down car 13 between the clamp stands 31 and 32.

The clamp stands 31 and 32, end roller rack stands 36 and 37 and center roller rack stand 38 are all mounted on main frame members or frame rails 39 and 40 of the tie down car 13. Each set of end roller rack stands 36 or 37, clamp stands 31 and 32 and the center roller rack stand 38 are formed from seven sets of vertical posts 41*a*-47*a* and 41*b*-47*b* extending in spaced relation inward from each end of the tie down car 13.

End roller rack stand 36 is formed on first and second sets of aligned vertical posts 41*a* and 42*a* and end roller rack stand 37 is formed on vertical posts 41*b* and 42*b*. Five roller support shelves 51*a-e* are mounted on and extend in vertical spaced alignment between posts 41*a* and 42*a* and five roller support shelves 52*a-e* are mounted on and extend in vertical spaced alignment between posts 41*b* and 42*b*. Each shelf 51*a-e* is formed from cross-frame members 53*a* and 54*a* extending between aligned posts 41*a* and 42*a* respectively. Each shelf 52*a-e* is formed from cross-frame members 53*b* and 54*b* extending between aligned posts 41*b* and 42*b* respectively. Roller mounting plates 56 are mounted on and extend between the cross-frame members 53*a* and 54*a* and cross frame members 53*b* and 54*b* in equally spaced relation and one rail support roller 58 is rotatably mounted to and between adjacent mounting plates 56. In the embodiment shown, each roller support shelf 51*a* and 51*b* is adapted to support eight rails across its width so there are eight rollers 58 supported between nine roller mounting plates 56 on each shelf 51*a* and 51*b*. Adjacent rollers 58 are mounted in a staggered relationship to allow mounting of the ends of two roller axles on each roller mounting plate 56.

Tapered rail guides or guide flanges 60 are welded to the cross-frame members 53 to guide a rail threaded onto the tie down car 13 onto the rollers 58 and through the tie down car 13 in the proper spacing across its width. Because the embodiment shown is adapted to support eight rails across each shelf 33*a-e* and 34*a-e*, nine rail guides 60 are welded to each cross-frame member 53 generally in alignment with the nine roller mounting plates 56 to guide the rails onto associated rollers 58 between each set of guides 60.

Center roller rack stand 38 is formed on first and second sets of aligned vertical posts 47*a* and 47*b*. Three center roller support shelves 61*a-c* are mounted on and extend in vertical spaced alignment between posts 47*a* and 47*b*. Each shelf 61*a-c* is constructed in a manner similar to roller support shelves 51*a-e* and 52*a-e* and includes nine rail support rollers 62 mounted on roller mounting plates 63 supported on cross frame members 64 and 65 which are connected to and extend between the pairs of vertical posts 47*a* and 47*b*.

Each level of the roller support shelves and clamping shelves extends at the same height. For example, first and second end roller support shelves 51*a* and 52*a*, center roller support shelf 61*a* and clamping shelves 33*a* and 34*a* all extend at the same height and are the highest level in the embodiment shown. Similarly, first and second end roller support shelves 51*e* and 52*e* and clamping shelves 33*e* and 34*e* all extend at the same height and are the lowest level in the embodiment shown.

In the embodiment shown, only three roller support shelves 61*a-c* are needed to support the rails 3 as they span the gap between the aligned clamping shelves 33*a-c* and 34*a-c* respectively. The gap between aligned clamping shelves 33*d* and *e* and shelves 34*d* and *e* is sufficiently narrow that additional support therebetween is not necessary. A generally accepted length for unsupported rail to prevent sagging is approximately thirty feet.

In the embodiment shown, each clamp stand shelf 33*a-e* and 34*a-e* includes or supports four rail clamp assemblies 30 for supporting four of the eight rails 3 on each shelf 33*a-e* and 34*a-e*. For example, clamping assemblies 30 on shelf 33*a* may be described as positioned to clamp onto rails r1, r3, r5 and r7 while the clamping assemblies 30 on shelf 34*a* are positioned to clamp onto rails r2, r4, r6 and r8. Clamp assemblies 30 corresponding to only half the rails 3 to be supported per shelf are used due to the size of the clamp assemblies 30. If clamp assemblies 30 for all of the rails 3 in each row of rails 3 were to be supported on a single clamp stand shelf, the number of rails per row would be limited to the number of clamp assemblies that could be spaced across the width of the car which is fewer than if half the clamp assemblies per row are supported on separate shelves.

As seen from a top view of the tie down car, the position of the clamp assemblies 30 on each adjacent shelf 33*a-e* and 34*a-e* may be offset. For example, in the embodiment shown, on shelf 33*b*, the clamp assemblies 30 are positioned to clamp onto the even rails, r2, r4, r6 and r8 and on shelf 34*b* the clamp assemblies 30 are positioned to clamp onto the odd rails, r1, r3, r5 and r7, which is offset from the clamp assembly positions on shelves 33*a* and 34*a*.

Figure 9:
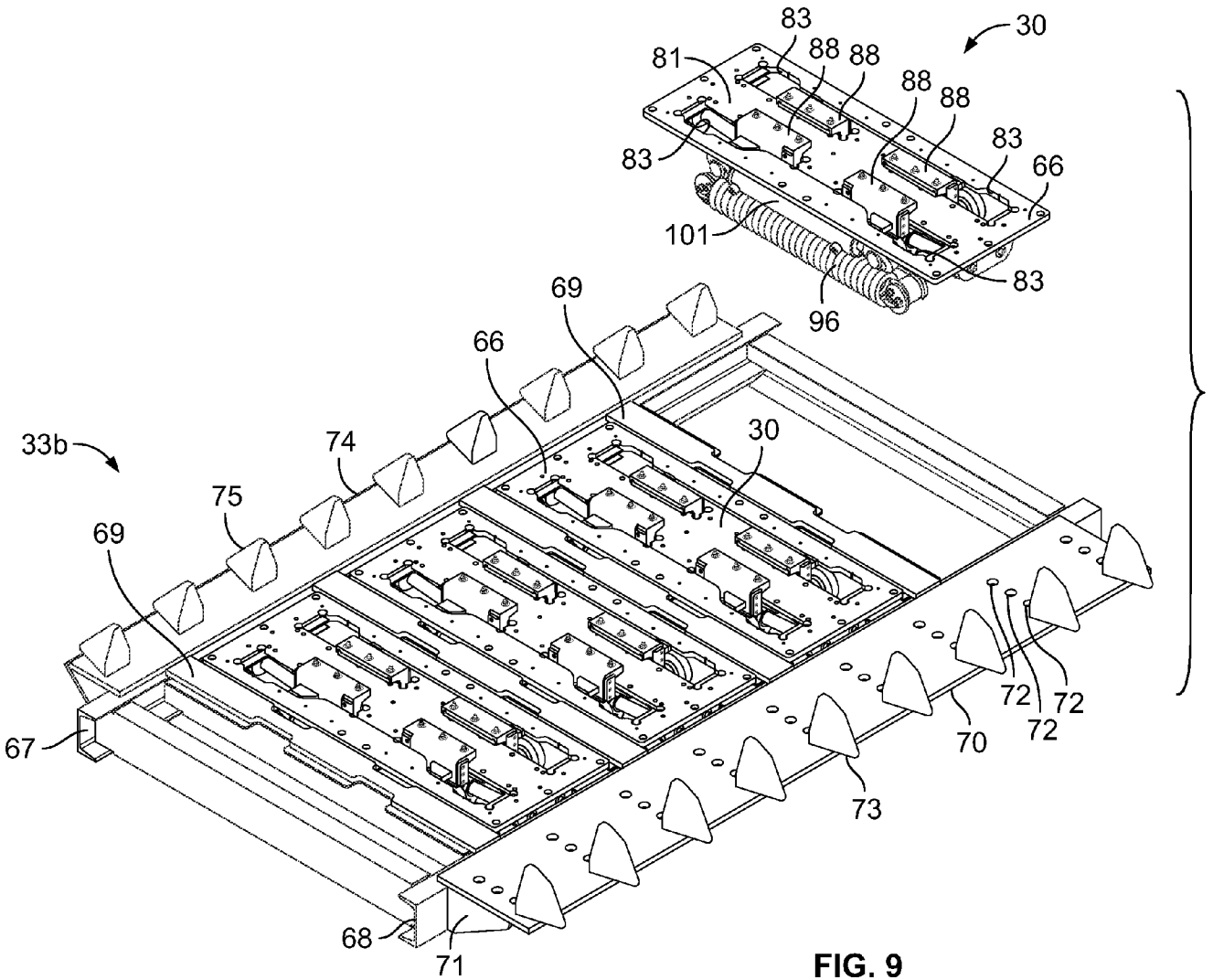
FIG. 9 is an enlarged and exploded perspective view of one of the shelves of the rail tie-down car with one of the clamping assemblies shown separated from the shelf.
Figure 10:
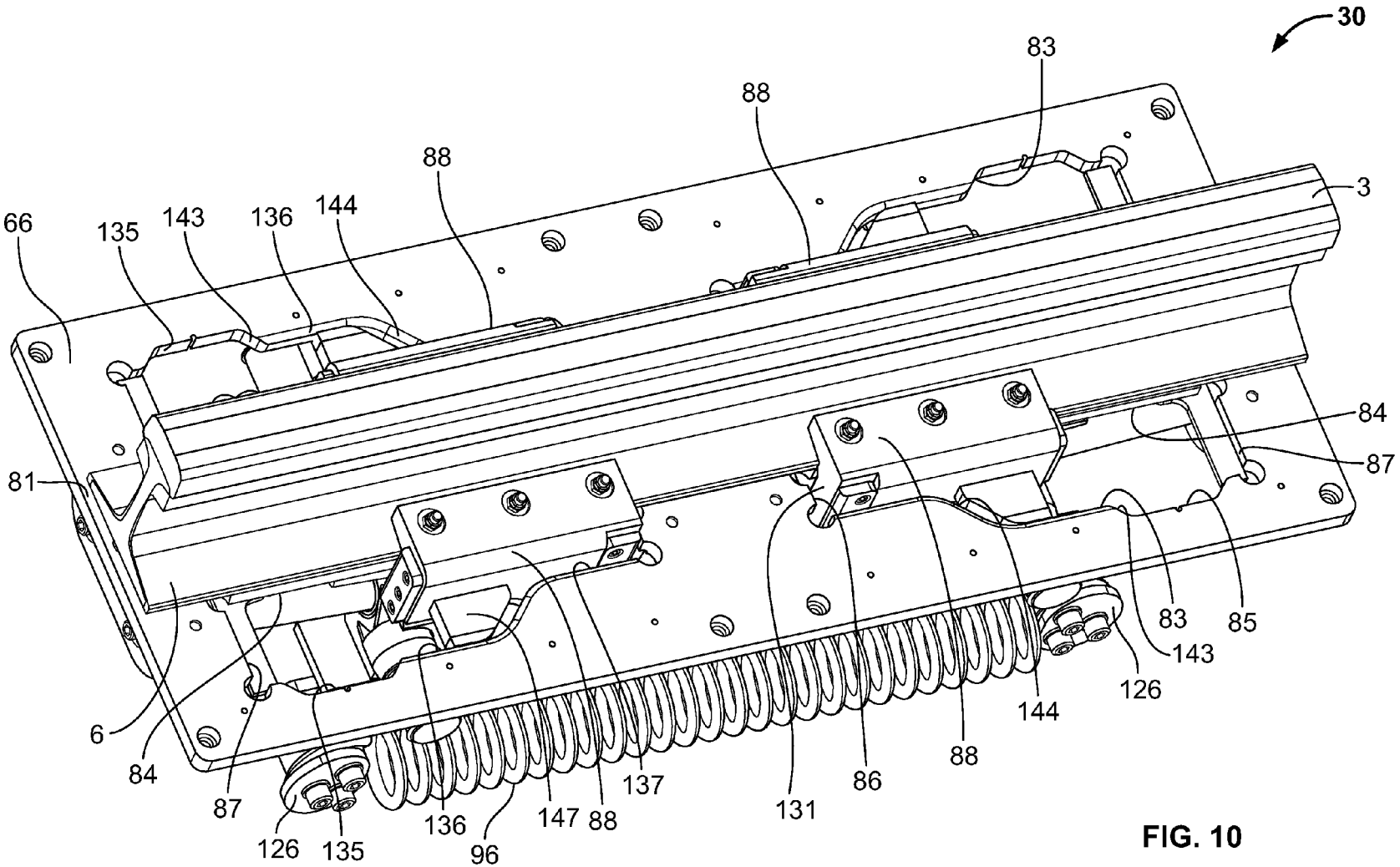
FIG. 10 is a top perspective view of the clamping assembly with a fragmentary section of rail clamped thereto.
Figure 11:
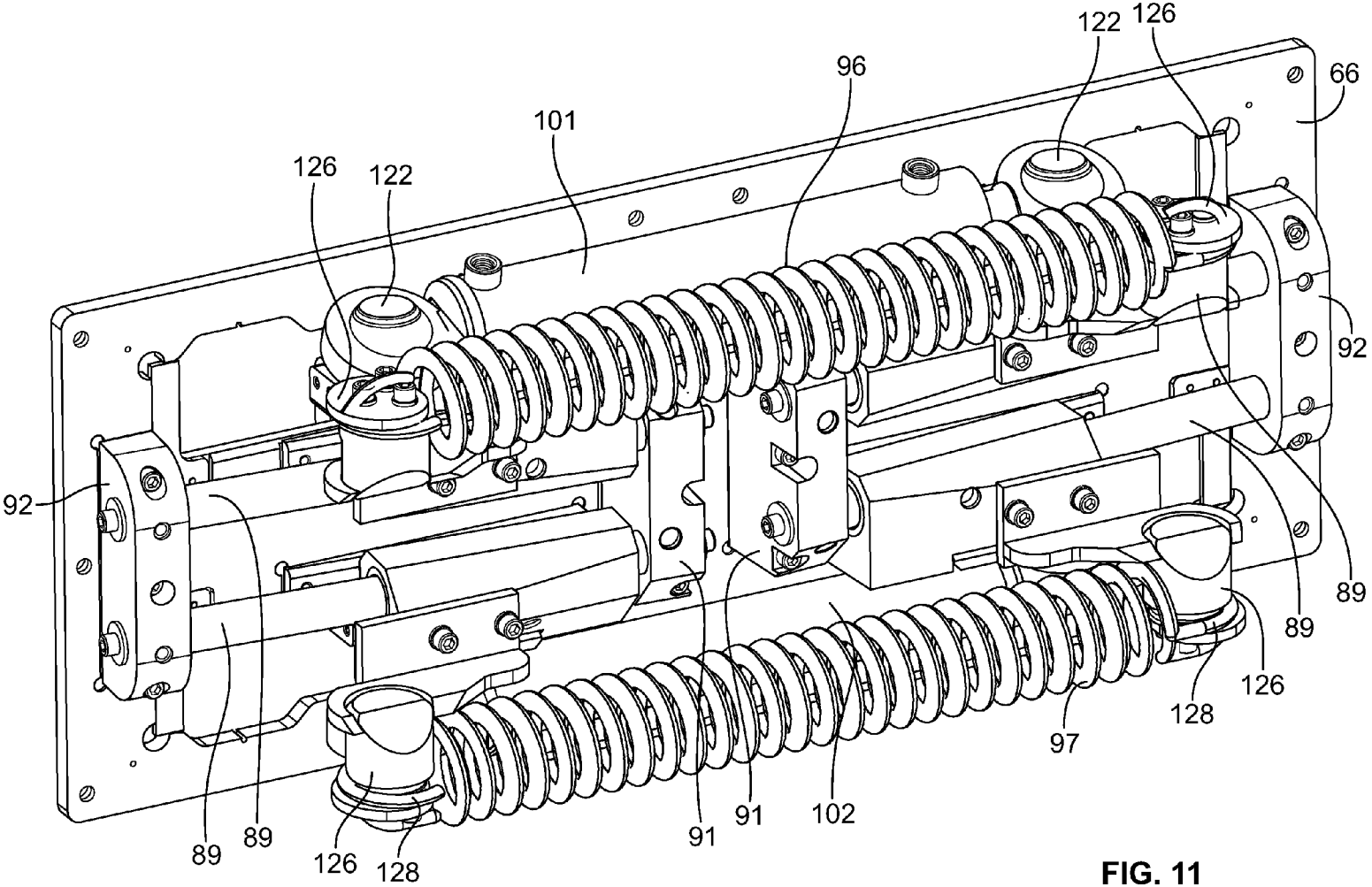
FIG. 11 is a bottom perspective view of the clamping assembly with a fragmentary section of rail clamped thereto.
Figure 12:
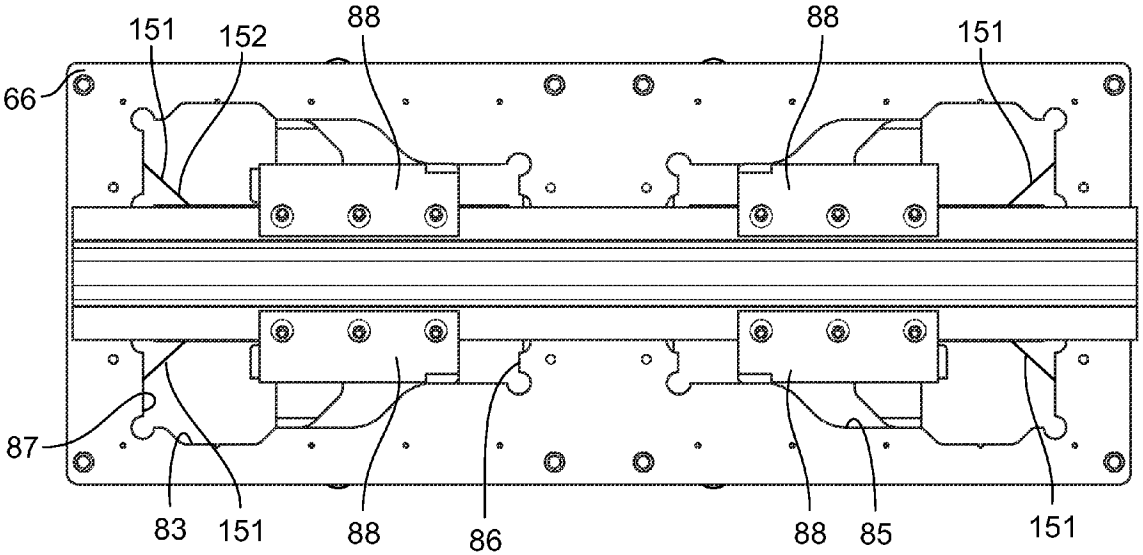
FIG. 12 is a top plan view of the clamping assembly with a fragmentary section of rail clamped thereto.

Referring to FIG. 9, each primary clamp assembly 30 includes a base plate or primary clamp plate 66 to which the rest of the components are attached. Each clamp stand shelf 33*a-e* and 34*a-e* is formed by a pair of cross-frame members or outer and inner cross-frame members 67 and 68 mounted on and extending between adjacent sets of vertical posts 42-47 (not shown in FIG. 9). A plurality of struts or clamp assembly supports 69 extend between the cross-frame members 67 and 68 in spaced apart relation to form four clamp receiving pockets per shelf. Each clamp assembly 30 is positioned in one of the pockets with the base plate 66 bolted to and extending between adjacent clamp assembly supports 69.

Auxiliary clamp plates 70 are mounted on each clamp stand shelf 33*a-e* and 34*a-e* along an inner edge thereof, adjacent to and level with the primary clamp plates 66. The auxiliary clamp plates 70 are welded to the inner cross frame members 68 and project past the cross-frame members 68 in cantilevered fashion toward the center of the tie down car 13. Gussets 71 or the like may be used to provide additional support to the auxiliary clamp plates 70. Each auxiliary clamp plate 70 includes nine sets of three bolt holes 72 extending therethrough sized to receive bolts of conventional rail clamping shoes (not shown) which can be used to clamp rails 3 to the clamp stands 31 and 32 should the hydraulic system or individual primary clamp assemblies 30 fail. The bolt holes 72 are arranged on opposite sides of the area of the plate 70 across which the rails 3 are supported. Tapered rail guides 73 are welded to the auxiliary clamp plate 70 in line with the aligned sets of bolt holes 72 and with the rail guides 61 on the associated roller support shelves 51*a-e* and 52*a-e*.

An outer guide plate 74 is welded to the outer cross-frame member 67 of each clamp stand shelf 33*a-e* and 34*a-e*, adjacent to and level with the primary clamp plates 66. A plurality of tapered rail guides 75, nine in the embodiment shown, are welded to each outer guide plate 74 in equally spaced relation and corresponding to the spacing of rail guides 61 on the associated roller support shelves 51*b-e* and 52*b-e*. No rail guides 75 are welded to the outer guide plate 74 of shelves 33*a* and 34*a* because these shelves are sufficiently close to roller support shelves 51*a* and 52*a* that additional guides are not needed.

Referring again to FIGS. 6 and 7, four rail support channels 77*b-e* extend between each roller support shelf 51*b-e* and each aligned clamping shelf 33*b-e* in alignment with the clamp assemblies 30 supported on the respective clamping shelf 33*b-e*. Similarly four rail support channels 78*b-e* extend between each roller support shelf 52*b-e* and each aligned clamping shelf 34*b-e* in alignment with the clamp assemblies 30 supported on the respective clamping shelf 34*b-e*. The rail support channels 77*b-e* and 78*b-e* are supported on cross-frame members 67 and 68 and open upward. The rail support channels 77*b-e* and 78*b-e* function to support the rails 3 against downward deflection as they are threaded from the roller support shelves 51*b-e* and 52*b-e* to the clamping shelves 33*b-e* and 34*b-e*; and to further help guide the rails 3 into the corresponding clamp assembly 30.

Referring again to FIGS. 9-20, the base plate 66 of each clamp assembly 30 includes a longitudinal receiving section 81 on which the base flange 6 of the respective rail 3 rests. Four elongate clamp slots 83 are formed through the base plate 66 adjacent to the receiving section 81, with a pair of the clamp slots 83 positioned on each side of the receiving section 81. Each clamp slot 83 includes inner and outer edges 84 and 85 relative to a longitudinal axis extending through the receiving section 81 and inner and outer end walls 86 and 87 relative to a lateral axis extending through the receiving section 81. Each clamp assembly 30 further comprises four clamping members or hooks 88, each slidably mounted on a guide rod or shaft 89 that is mounted below the base plate 66 with each hook 88 extending upward through a respective one of the clamp slots 83.

Each guide rod 89 is mounted to the underside of the base plate 66 by inner and outer stanchions 91 and 92 supporting inner and outer ends 93 and 94 of each guide rod 89 respectively. An outer stanchion 92 is mounted to and extends below the base plate 66 just past the outer end walls 87 of each pair of laterally aligned slots 83. Similarly an inner stanchion 91 is mounted to and extends below the base plate 66 just inside of the inner end walls 86 of each pair of laterally aligned slots 83. It is foreseen that the inner stanchions 91 could be formed as a single stanchion.

The guide rods 89 are supported on the associated inner and outer stanchions 91 and 92 such that the guide rods 89 slope upward from the inner stanchions 91 to the outer stanchions 92. Each guide rod 89 generally extends parallel to and below the inner edge 84 of each clamp slot 83 generally along the full length of the slot 83.

Tension springs 96 and 97 function as clamping means and are connected between longitudinally adjacent hooks 88 to normally draw the hooks 88 toward the inner end wall 86 of each slot 83 which corresponds to a closed or clamping position of the hooks 88 relative to the associated rail 3. Two springs, one nested within the other may be used to increase the spring force acting on the hooks 88. Double acting hydraulic actuators 101 and 102 are connected on opposite ends to longitudinally adjacent hooks 88 and function as release means. More specifically, the actuators 101 and 102 are operable to drive adjacent hooks 88 outward against the biasing force of the springs 96 and 97 from a clamping position proximate the inner end wall 86 of each slot 83 to an open position, at the opposite end of the slot 83 proximate the outer end wall 87 and for drawing the longitudinally adjacent hooks 88 back to the clamping position. As described, the actuators 101 and 102 may be described as remotely providing both the release and the clamping functions.

The springs 96 and 97 function to hold the hooks 88 in the clamping position once a pump (not shown) for supplying hydraulic fluid to the actuators 101 and 102 is shut-off, such as during transport of the rails 3 on the train 1, which may take days or weeks. It is to be understood that different types of actuators other than the hydraulic actuators 101 and 102 might be utilized, including pneumatic actuators or solenoids. The actuators shown are linear actuators, but it is foreseen that other types of actuators, mechanisms or linkages may be used for acting on and moving the hooks 88 remotely.

Wedges 105 mounted to the underside of the base plate 66 in alignment with the guide rods 89 and sloping downward toward inner ends thereof, act on the hooks 88 to urge the hooks 88 downward and into clamping engagement with the feet 8 and 9 of the rail base flange 6 as the hooks 88 are drawn inward by the springs 96 and 97.

Each clamping member or hook 88 includes a generally tubular guide sleeve or hub 111, a shank 112 projecting outward from and generally tangential to the hub 111 and a clamping flange 113 which is positioned at an upper end of the shank 112. The clamping flange 113 extends perpendicularly inward from the shank 112 and over the guide sleeve 111 in spaced relation thereto. An axis of each guide sleeve 111 extends at an acute angle relative to the clamping flange 113 such that an inner end 116 of the guide sleeve 113 is lower or spaced further away from the clamping flange 113 than its outer end 117.

A sloping gap 119 is thereby formed between the guide sleeve 111 and the clamping flange 113 of each hook 88. The gap 119 opens inward toward the base plate longitudinal receiving section 81 and is wider at the inner end 116 than the outer end 117 of the guide sleeve 111. The angle formed between the clamping flange 113 and guide sleeve 111 of each hook 88 corresponds to the angle or downward slope of the wedge 105 toward the inner end wall 86 of each slot 83. The gap 119 between the guide sleeve 111 and clamping flange 113 is sized to receive at least a portion of the wedge 105 so that as the hook 88 is drawn inward by the springs 96 or 97 toward the clamping position, movement of the upper surface of the guide sleeve 111 along the lower surface of the wedge 105 draws the hook clamping flange 113 down and against the rail flange foot 8 or 9.

An actuator mount 122 is formed on and projects outward from an outer surface or rear face 123 of each hook 88. In the embodiment shown the actuator mounts 122 comprise mounting studs which project outward from the guide sleeve 111 proximate the outer end 117 thereof. It is foreseen that the mounts 122 could comprise other structure, such as clevises or the like. Eyelet connectors 124 formed on each end of the actuators 101 and 102 are used to connect the actuators 101 and 102 to the respective actuator mounts 122 on the hooks 88. The eyelet connectors 124 preferably are of a type having a semi-spherical bearing or ball joint to allow freedom of movement of the actuator end relative to the actuator mount 122.

A spring mount or mounting stud 126 is also formed on or connected to each hook 88. The spring mounts 126 are spaced below the actuator mounts 122. Hooks 128 formed on the ends of the springs 96 and 97 are used to attach the springs 96 and 97 to the spring mounts 126. Springs 96 and 97 are tension springs and normally bias or draw the hooks 88 to a retracted or clamping position. It is understood that more than one spring could be used to urge or draw the hooks 88 to the clamping position and that one end of each hook could be connected to a fixed structure such as a mounting post on the inner stanchions 91 for drawing the hooks 88 inward.

The inner edge 84 of each clamp slot 83 is relatively straight and extends parallel to an inner edge 84 of the slot 83 on the opposite side of the receiving section 81. The inner edges 84 of slots 83 generally define the outer edge of the receiving section 81. The outer edge 85 of each clamp slot 83 is contoured inward from the outer end wall 87 to the inner end wall 86 so that the slot is narrower proximate the inner end wall 86 than near the outer end wall 87. The edge of said base plate 66 forming the outer edge 85 of each slot 83 functions as a guide and is engaged by an inner edge 131 and a rear face 123 of the hook 88 extending through the slot 83 to cause the hook 88 and its clamping flange 113 to pivot inward about the respective rail guide 77 as the hook is drawn by the springs 96 or 97 to the clamped position and to allow the hook 88 and clamping flange 113 to pivot outward to an open position and spaced, away from a rail 3 supported on the receiving section 81 of the clamp base plate 66.

Figure 16:
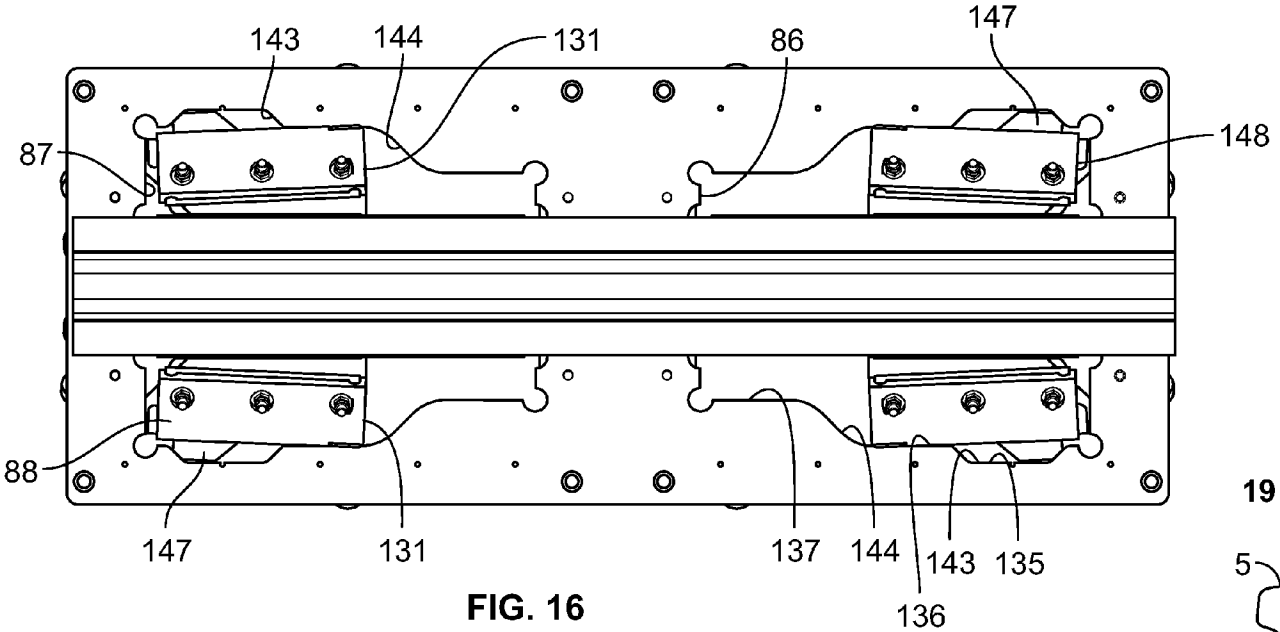
FIG. 16 is a top plan view of the clamping assembly in an unclamped alignment with a fragmentary section of rail supported thereon.

Referring to FIG. 16, each clamp slot 83 includes a wide portion 135 proximate the respective outer end wall 87, an intermediate portion 136 and a narrow portion 137 proximate the respective inner end wall 86. First and second inwardly sloping transition sections 143 and 144 extend between the wide portion 135 and the intermediate portion 136 and the intermediate portion 136 and the narrow portion 137 respectively of clamp slot 83. An edge follower 147 is mounted on the rear face 123 of each hook 88 proximate an outer end 148 thereof.

The narrow portion 137 of each clamp slot 83 is just slightly wider than the width of the hook shank 112 so that when the hook 88 is drawn to the clamping position, the hook shank 112 is maintained in a perpendicular or vertical alignment relative to the base plate 66 and the clamping flange 113 projects over the receiving section 81 and over one of the feet 8 or 9 of the rail base flange 106. When the hook 88 is driven outward toward the outer end wall 87 of the slot 83 so that the hook 88 is positioned in the wide and intermediate portions 135 and 136 of the slot 83, the hook 88, including the clamping flange 113 can pivot away from the receiving section 81 to an open alignment.

Because the actuators 101 and 102 are connected to and supported outward from the rear faces 132 of longitudinally aligned pairs of hooks 88 and the springs are similarly spaced outward from the rear face of the hooks 88, the weight of the actuators 101 and 102 causes the hooks 88 to pivot to an open alignment as the hooks 88 are moved into the intermediate and wide portions 136 and 135 of the slots 83. Stated differently, the center of mass of each hook 88 and the spring 96 or 97 and actuator 101 or 102 connected thereto, is spaced outward from the axis of the hook hub 111 causing the hook 88 to pivot outward about the guide rod 89 to which it is attached as the hook 88 is moved into the intermediate and wide portions 136 and 135 of the slots. It is noted that the wide portion 135 of the slot 83 is wider than the distance from an inner face of the hook shank 112 and an outer edge of the edge follower 147 such that when the edge follower 147 is advanced into the wide portion 135 of the slot 83 as the hook 88 is advanced outward, the hook 88 can then pivot outward. A hook opening guide member 151 (shown only in FIG. 12) presenting an outwardly sloping edge 152 may be mounted to the base plate 66, adjacent a corner between the outer end wall 87 and the inner edge 84 of the slot 83, to force a hook 88 to pivot outward as it is driven toward the end wall 87 and against the guide member 151, to ensure that the hooks 88 are advanced to an open alignment.

When the hooks 88 are in the open position discussed above, an inner end 131 of the hook 88 is positioned in the intermediate portion 136 of the slot 83 and the edge follower 147 is in the wide portion 135 of the slot 83. As each hook 88 is drawn toward the inner end wall 86, the inner end 131 of the hook 88 engages the portion of the base plate 66 forming the inner or second transitions section 144 of the slot 83 causing the hook 88 to pivot inward as the hook 88 is driven further toward the inner end wall 86 of slot 83. As the hook 88 pivots inward, the edge follower 147 on the hook shank 112 is pivoted upward into alignment with the intermediate portion 136 of the clamp slot 83. As the hook inner end 131 is advanced into the narrow portion 137 of the slot 83, the edge follower extends adjacent the portion of the base plate 66 forming the intermediate portion 136 of the slot 83 to urge the outer end 148 of the hook 88 toward the inner edge 84 of the slot 83. By holding the outer end 148 of the hook 88 toward the inner edge 84 of slot 83 the edge follower 147 helps ensure that the clamping flange 113 engages and clamps against the respective foot 8 or 9 of the rail base flange 6 along the entire length of the clamping flange 113.

Figure 15:
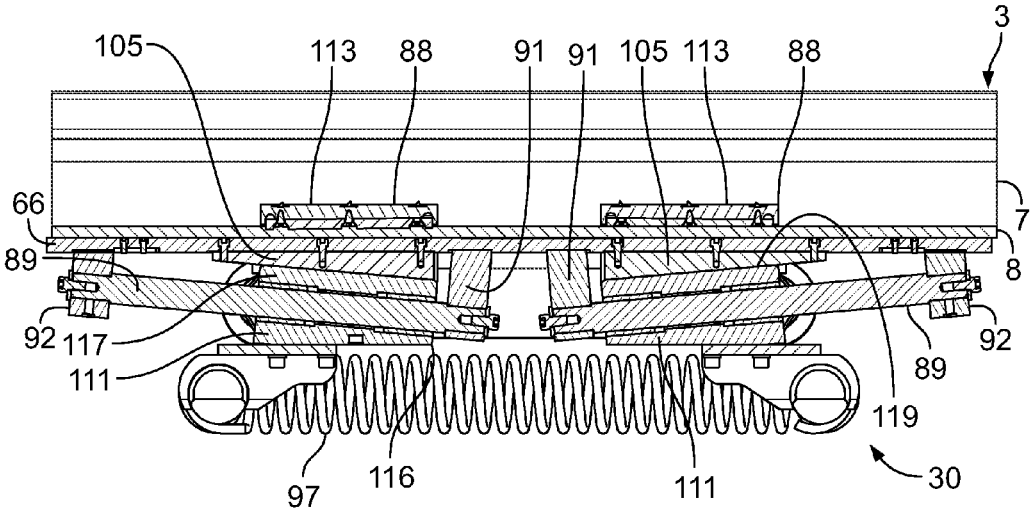
FIG. 15 is a cross-sectional view of the clamping assembly with a fragmentary section of rail clamped thereto taken along line 15-15 of FIG. 13.

Referring to FIG. 15, it is seen that as each hook 88 is drawn inward, from the wide portion 35 of the slot 83 toward the inner end wall 86 of the slot 83, an upper surface of the hook hub 111 engages a lower, inwardly and downwardly sloping surface of the wedge 105, forcing the hook 88, including the clamping flange 113 downward as the hook 88 is drawn further inward toward the inner end wall 86 of the slot 83. The hook 88 is drawn downward until an inner surface of the clamping flange 113 engages the upper surface of one of the feet 8 or 9 of a rail 3 positioned on the rail receiving section 81 of the base plate 66.

Figure 19:
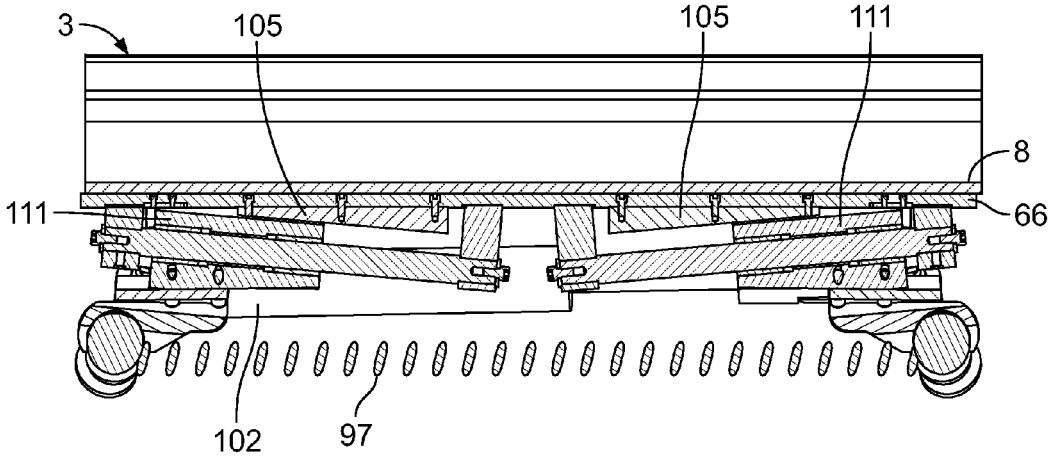
FIG. 19 is a cross-sectional view of the clamping assembly in an unclamped alignment with a fragmentary section of rail supported thereon taken along line 19-19 of FIG. 17.
Figure 20:
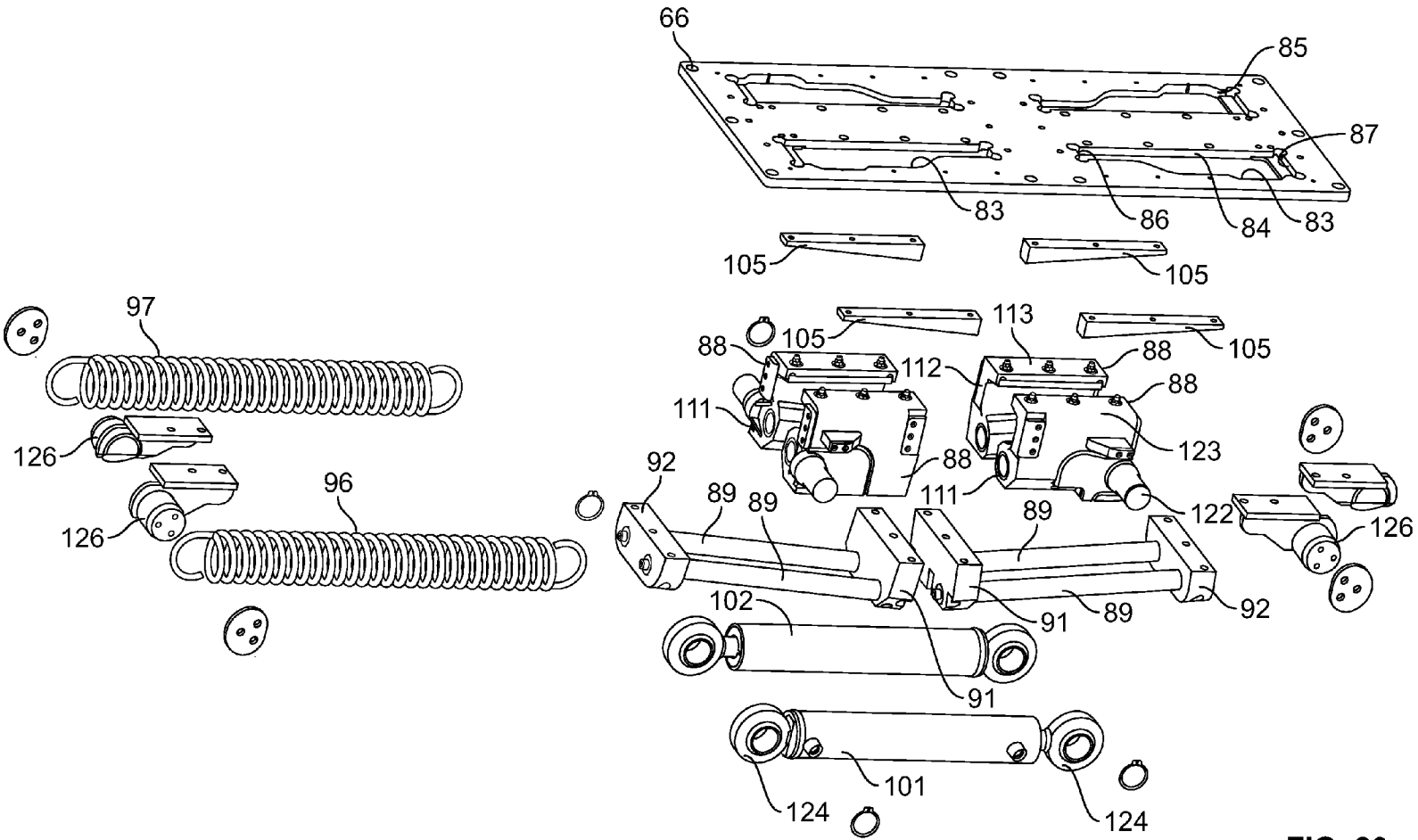
FIG. 20 is an exploded perspective view of the clamping assembly.

As seen in FIGS. 15 and 19, the wedges 105 associated with longitudinally adjacent slots 83 and hooks 88, slope downward toward each other. Once a rail 3 is clamped in place by the longitudinally adjacent hooks 88, the rail is restrained from sliding longitudinally in either direction by the oppositely acting wedges 105. For purposes of discussing the action of the clamp assembly 30 and with reference to FIG. 15, the left side of the drawing will be considered to be extending to the rear of a train and the right side of the drawing will be considered extending toward the front of the train. If the rail 3 is urged to the right or front of the train, the hook 88 on the left or rear side will be drawn to the right or forward against the downwardly sloping left side wedge 105 further increasing the downward clamping action of hook clamping flange 113 on the rail foot 8 and further resisting forward movement of the rail 3 relative to the clamping assembly 30. If the rail 3 is urged to the left or rear of the train, the hook 88 on the right or front side will be drawn to the left or rearward against the downwardly sloping right side wedge 105 further increasing the downward clamping action of hook clamping flange 113 on the rail foot 8 and further resisting rearward movement of the rail 3 relative to the clamping assembly 30. Bearing surfaces of the hooks 88 preferably are formed from brass or other material that facilitates the release of the hook 88 from clamping engagement with the associated wedge 105.

Figure 21:
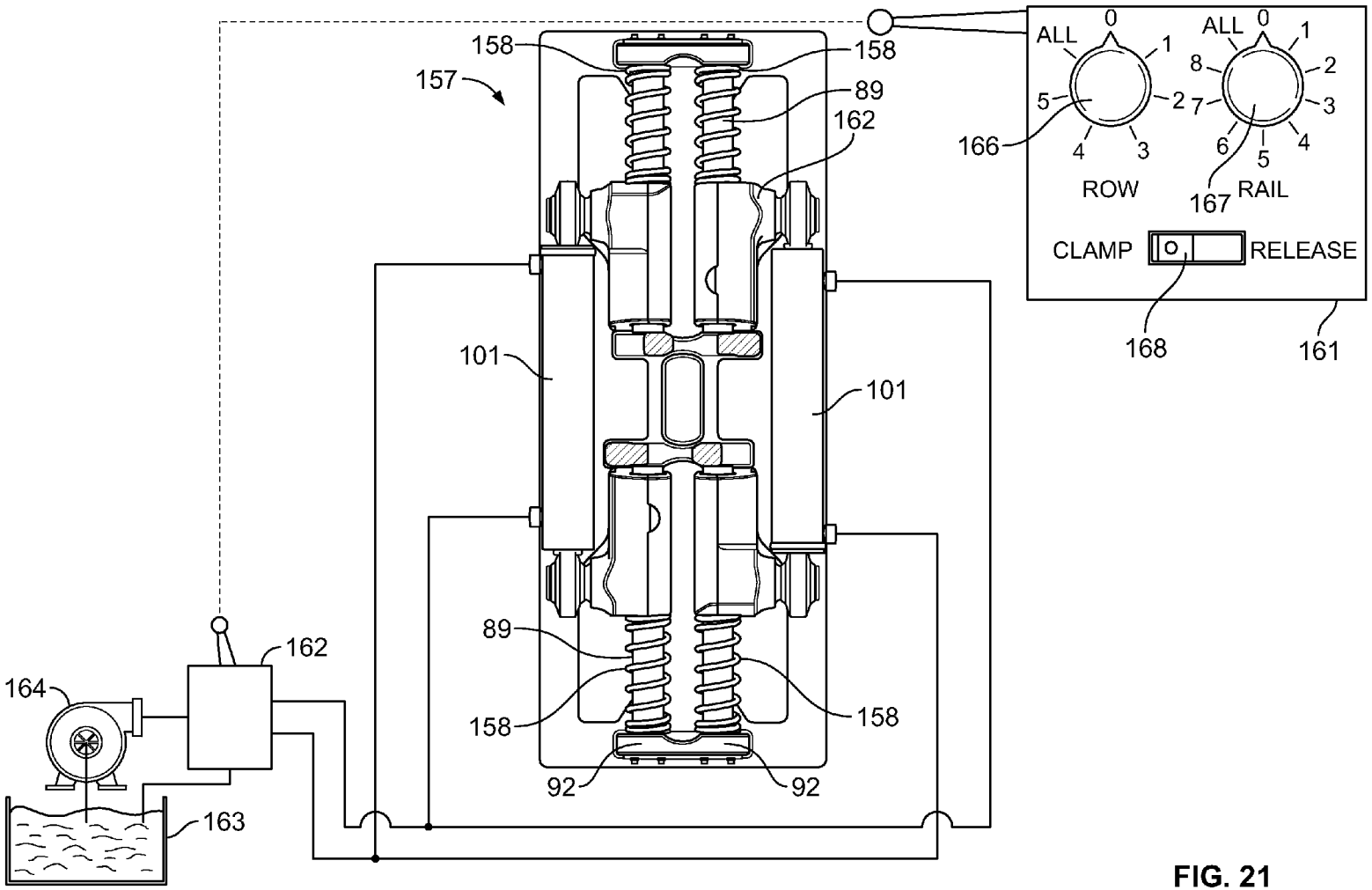
FIG. 21 is a bottom plan view of an alternative embodiment of the clamping assembly with a control system for the clamping assembly shown schematically.

FIG. 21 shows an alternative embodiment of a clamp assembly 157 which is similar in construction to clamp assemblies 30, except that compression springs 158 are used for urging modified hooks or clamp members 159 into clamping engagement with a rail supported on the rail support base 66. Hooks 159 are similar in construction to hooks 88 except that hook mounts 126 are not necessary and therefore are not formed on or included on the hooks 159. The remaining elements of the clamp assembly 157 are generally the same as for clamp assemblies 30 and are similarly numbered.

A compression spring 160 is positioned around each guide rod 89 with one end abutting against the associated hook 162 and an opposite end abutting against the outer stanchion 92 to urge the hook 162 inward toward an inner edge 84 of the clamp slot 83. The compression springs as shown function to normally bias or urge the hooks 162 into clamping engagement with a rail supported on the rail base. The actuators 101 are used to advance the hooks 162 into and out of clamping engagement with the rails, but the springs ensure the clamps will be urged into clamping engagement with a rails positioned therebetween if power (hydraulic pressure in the application shown) to the actuator is lost.

It is to be understood that compression or tension springs could be used to bias the clamp hooks into or out of clamping engagement with a rail supported on the rail base such that springs could function as either clamping means or release means acting on the clamp hooks. Similarly actuators of the type disclosed herein can be used as either clamping or release means or both acting on the clamp hooks to advance them into and out of clamping engagement with a rail supported on the rail base. Actuators other than hydraulic actuators, including pneumatic actuators, solenoids or mechanical linkages could be used to move the clamp hooks into and/or out of clamping engagement with a rail supported on the rail base to permit remote engagement and disengagement of the clamp hooks with a rail supported on the clamp base.

As used herein, reference to remote engagement or disengagement of the clamp hooks is intended describe systems that allow an operator to cause the clamping members to clamp onto or release from clamping a rail to the clamp assembly or tie down car without requiring the operator to manually position the clamping member in engagement with or remove the clamping member from engagement with the rail such as by bolting the clamping member in place or manually operating a mechanical clamping assembly for advancing the clamping member into and out of engagement with the rail.

As shown schematically in FIG. 21, a radio controller 161 communicates with a valve assembly 162, controlled by the controller 161, to control the flow of hydraulic fluid between the double acting hydraulic actuators 101 and a hydraulic fluid reservoir 163 and through pump 164. The controller 161 includes means for selecting the valve assembly or assemblies 162 associated with one or more clamp assemblies, such as clamp assemblies 158 or 30 to cause the clamp assembly to clamp one or more rails to the tie down car or release selected clamp assemblies from clamping engagement with the associated rails. The schematic diagram of controller 161 shows a row selection knob 166, a rail selection knob 167 and toggle switch 168. The row selection knob 166 is used to select the horizontal row of rails for which the clamp hooks are to be advanced into or out of clamping engagement with associated rails. The rail selection knob 167 is used to select the position of the rail in the selected row for which the clamp hooks are to be advanced into or out of clamping engagement therewith. The toggle switch 168 is then used to control whether the clamp members are advanced into or out of clamping engagement with the associated rail. As shown the rail selection knob 167 includes a setting to allow control of all of the clamping assemblies in a single row simultaneously. Similarly the row selection knob 166 may include a setting to allow control of all of the rows of clamping assemblies simultaneously.

It is to be understood that other types of controllers or control panels could be utilized. For example, the control panel could be a digital interface with a digital display and conventional electronic selection systems for selecting the desired clamping assemblies to be actuated. Such a system could permit greater variability in the clamping assemblies actuated. For example, such a controller might allow an operator to simultaneously release the clamping assemblies for two or more rails in the same or different rows. It is also foreseen that the controller could have a separate toggle type switch for each clamping assembly on the tie down car or cars 13. It is also to be understood that the connection between the controller 161 and the valves 162 could be a hard wired electrical connection or conventional hydraulic or pneumatic control systems which allow remote control of the clamping assemblies without an operator to have to climb onto the tie-down car to engage or disengage the clamping assemblies.

Rails 3 may be threaded into the tie-down car 13 or the rail support cars 15 from either end depending on how the cars are oriented on the train 1 relative to the tunnel cars 11 or 12. Tunnel cars 11 or 12 are used to facilitate loading and unloading rails 3 onto the train 1. The construction of front and rear tunnel cars 11 and 12 as shown in FIG. 1 are the same. Therefore, the description of rear tunnel car 12 below also applies to front tunnel car 11.

Referring to FIGS. 22-25, rear tunnel car 12 is built on a base frame 170 supported on trucks 171 and 172. The front tunnel car 11 may be of identical construction as the rear tunnel car 12. A floor grate 175 is supported on the base frame 170 and a rail support stand or tunnel 177 extends upward from the floor 175 proximate a front end 178 of the tunnel car 12. In the embodiment shown, the rail support stand 177 includes five rail support shelves 181*a-e* with each support shelf 181*a-e* supporting up to eight rails 3 in a what is generally referred to as a tunnel for a total of forty rails supported by the stand 177.

Two rail support arms 186 and 187 are mounted on the tunnel car 12 in recesses or pockets 188 formed in the tunnel car floor 175. Referring to FIG. 1, the rail support arms 186 and 187 are pivotal out of the recess 188 for use in supporting individual rails 3 as they are unloaded from the rail train 1 along the side of a track 4 and to assist in threading the rails 3 to a powered drive box 189 on a rail unloading machine 190 of the type shown in published patent application, Publication No. 20080141895, incorporated herein by reference.

Safety doors 191 and 192 are hingedly mounted on door frames 193 and 194 respectively which are connected to the tunnel car base frame 170 and project upward from the tunnel car floor 175 on opposite sides thereof. The doors 191 and 193 are closed during transport of the rails 3 by the train 1 to extend across the width of the end car 12 to function as a barrier to prevent any rails 3 which might come unclamped during transport from sliding off the back of the train 1. Similarly, barrier doors incorporated into the front end car 11 may be closed prevent unsecured rails from sliding forward of the barrier on end car 11.

The doors 191 and 192 are preferably opened and closed by hydraulic actuators 195 connected between the door 191 and 192 and the associated door frame 193 and 194. In the embodiment shown, the doors 191 and 192 open toward the rail support stand 177. A latch assembly 196 including cooperating latch members mounted on doors 191 and 192 automatically latch the doors 191 and 192 in a closed alignment when advanced thereto. A hydraulic latch release 199 may be incorporated into the latch assembly 196 to permit remote unlatching of the latch assembly 196.

The rail support stand or tunnel 177, is of conventional construction and includes sidewalls 201 and 202 projecting upward from the floor 175 on opposite sides of the tunnel car 12. The shelves 181*a-e* are supported between the sidewalls 201 and 202 in vertically spaced alignment. Rollers 204 may be rotatably mounted just behind each shelf 181*a-e* on an axis extending between the sidewalls 201 and 202. If rollers 204 are used, typically one roller is provided for each rail 3 to be supported on the shelf. In the embodiment shown, rollers 204 are only shown behind the top two shelves 181*a-b* due to greater potential wear on these shelves as the rails 3 are pulled off of the rail train due to the greater downward forces exerted on the upper shelves as the rail is drawn downward from a greater height.

Figure 33:
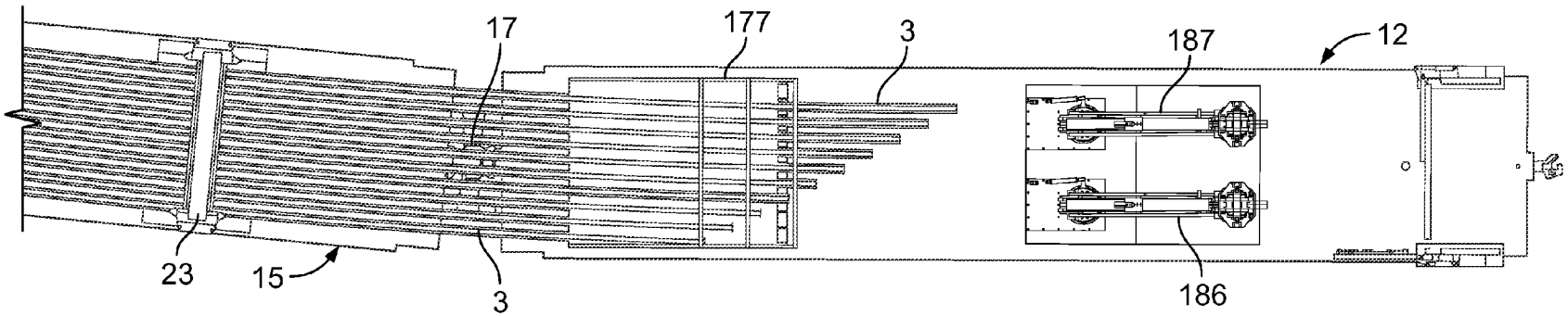
FIG. 33 is an enlarged and fragmentary top plan view of the rail train as shown in FIG. 32 showing an end car and a rail support car supported on a shared truck.
Figure 34:
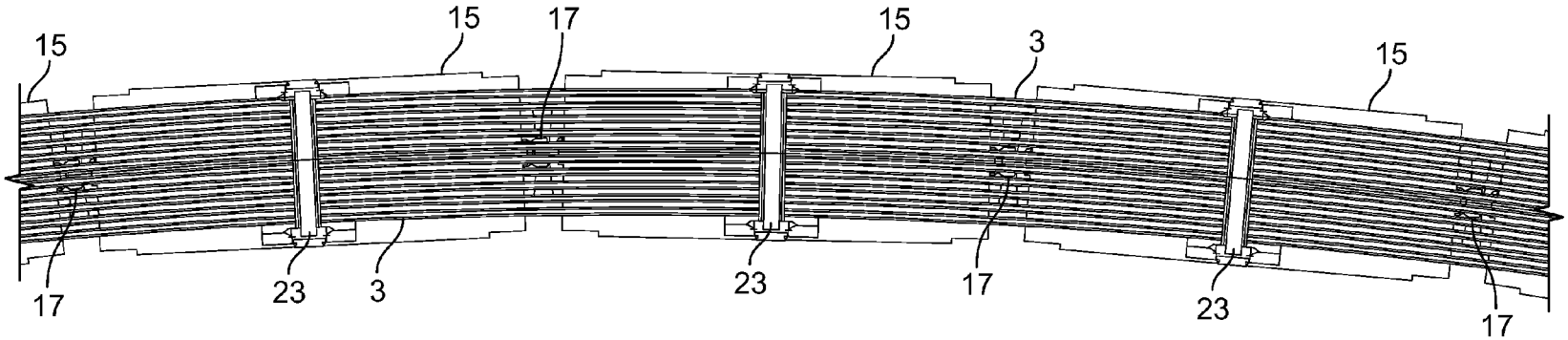
FIG. 34 is an enlarged and fragmentary top plan view of the rail train as shown in FIG. 34 showing a plurality of rail support cars supporting a plurality of ribbon rails.

Each shelf 181*a-e* is generally open across its width without any lateral restraints or obstructions to restrain lateral movement of the rails 3 supported thereon. The sidewalls 201 and 202 generally provide the only restraint to lateral movement of the rails 3 supported on shelves 181*a-e*. The rail support shelves 181*a-e* and sidewalls 201 and 202 are approximately six feet long in the embodiment shown to reduce the likelihood that the ends of the outermost rails 3 will be pulled off of the shelves 181*a-e* as the train 1 rounds a tight curve and the outer periphery expands considerably in length compared to the length of the rail 3 as depicted in FIGS. 33 and 34.

Figure 26:
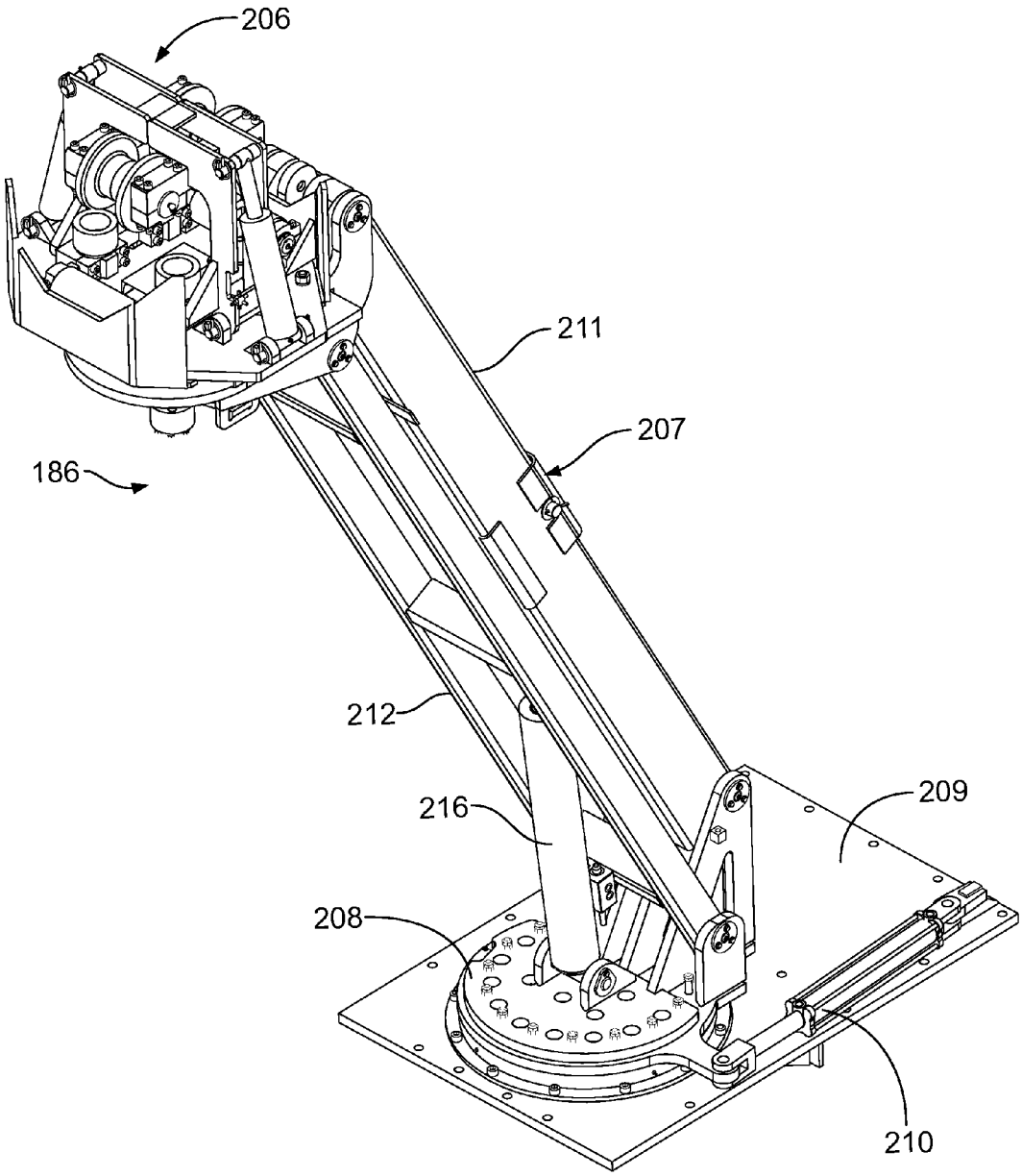
FIG. 26 is a perspective view of a rail support arm mounted on the end car in a raised orientation with a rail guide head mounted on a distal end thereof.
Figure 27:
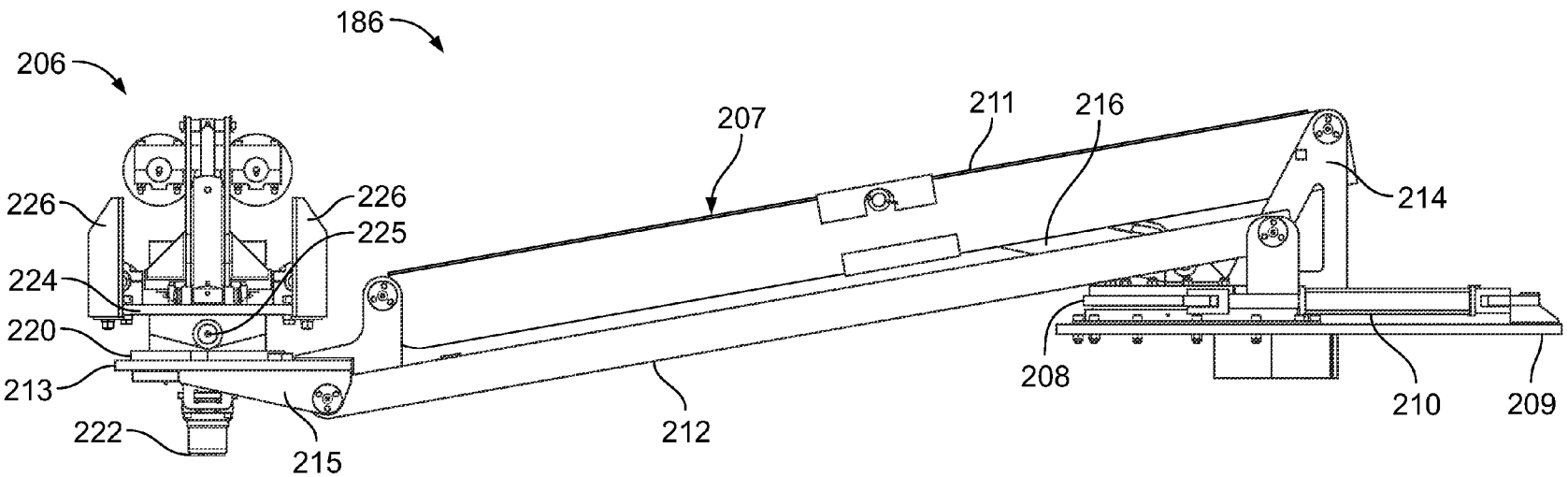
FIG. 27 is a side view of the rail support arm in a lowered position.
Figure 28:
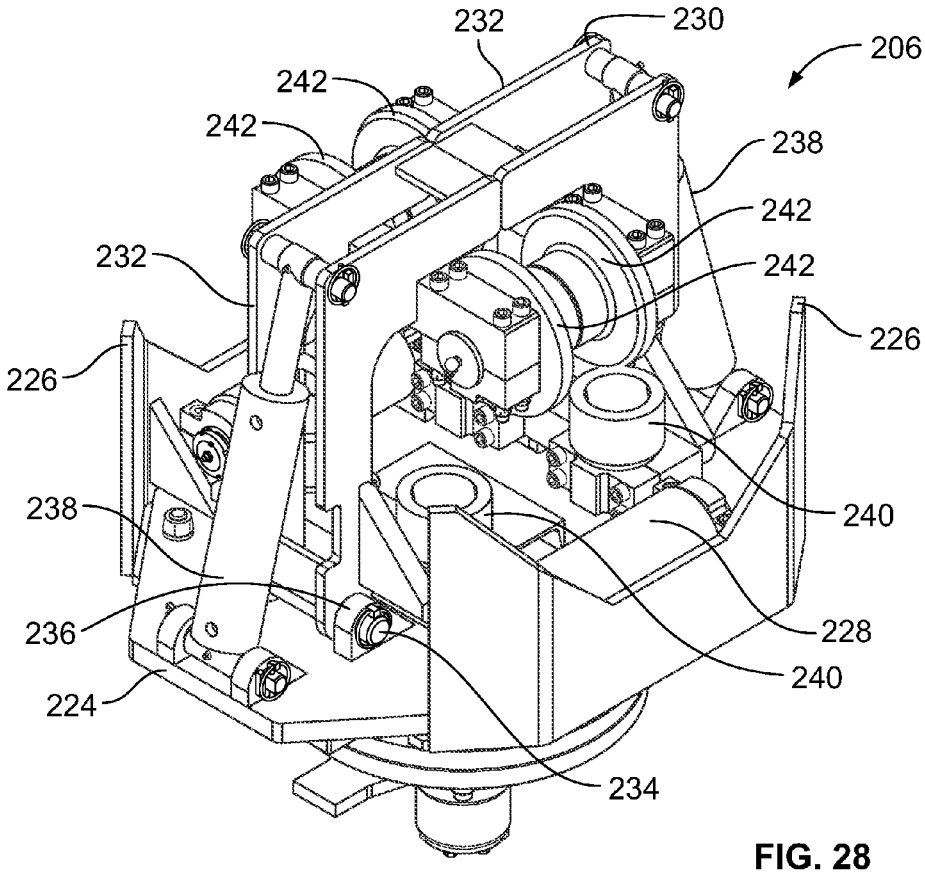
FIG. 28 is a perspective view of the rail guide head mounted on the rail support arm and shown in a closed position.

Referring to FIGS. 26 and 27, each rail support arm 186 and 187 incorporates a threader guide box or rail guide assembly 206 mounted on the distal end of a parallelogram linkage or lift arm 207 that is connected at its base end to a turntable or support arm mount 208 mounted on a support arm base plate 209. The support arm base plate 209 is connected to the end car frame 170 within the recess 188. A hydraulic actuator 210 connected between the turntable 208 and base plate 209 controls rotation of the turntable 208, relative to the base plate 209 and the end car frame 170 about a generally vertical axis through the turntable 208 and base plate 209. The parallelogram linkage 207 includes upper and lower link arms 211 and 212 pivotally connected at their base ends to the turntable 208 and at their distal ends to a guide box mount 213 in parallel spaced relationship. The base ends of upper and lower link arms 211 and 212 are pivotally connected to a base bearing mount 214 formed on the turntable 208 and the upper ends of upper and lower link arms 211 and 212 are pivotally connected to a distal end bearing mount 215 formed on the guide box mount 213.

A double acting, hydraulic actuator 216 pivotally connected at both ends between the turntable 208 and the upper link arm 211 of parallelogram linkage 207 is used to raise or lower the rail support arms 186 ad 187 out of and back into the recess 188 with the lift arm or parallelogram linkages 207 pivoting relative to the turntable 208. Each link arm 211 and 212 pivots about a generally horizontal axis. The recesses 188 are sized such that the rail support arms 186 and 187 may be pivoted relative to the turntable 208 to extend completely within the associated recess and such that no portion of the rail support arm 186 or 187 extends above a lower shelf 181*e* of the tunnel 177. Connection of the guide box mount 213 to the base turntable 208 by the parallelogram linkage 207 results in the guide box mount 213 maintaining a generally horizontal alignment as the rail support arms 186 and 187 are raised or lowered.

The threader guide box 206 of each rail support arm 186 and 187 is mounted on a guide box turntable 220 that is rotatably mounted on the respective guide box mount 213. The guide box turntable 220 is rotatably mounted relative to the guide box mount 213 about an axis extending generally vertically therethrough. Rotation of the guide box turntable 220 and the connected guide box 206 is controlled by a hydraulic motor 222 connected to the guide box mount 213. Each threader guide box 206 includes a generally flat platform 224 which is pivotally mounted to the turntable 220 by a pivotal coupling 225 so that the guide box 206 may pivot fore and aft relative to the turntable 220.

FIGS. 27-31 show the guide box 206 separated from the rest of the lift arm 186 or 187, including the guide box mount 213. Upstanding walls 226 are provided on opposing edges of the platform 224. A pair of support rollers 228 are mounted for rotation on the platform 224 adjacent to the walls 226 at locations to receive and support the flat, base flange 6 of a ribbon rail 3 positioned in the threader guide box 206.

Figure 29:
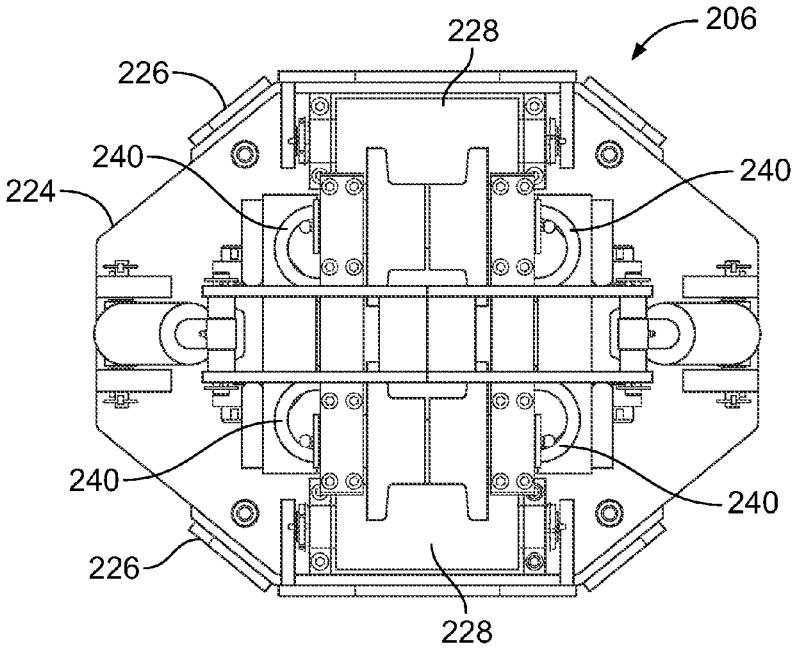
FIG. 29 is a top plan view of the rail guide head in the closed position.
Figure 30:
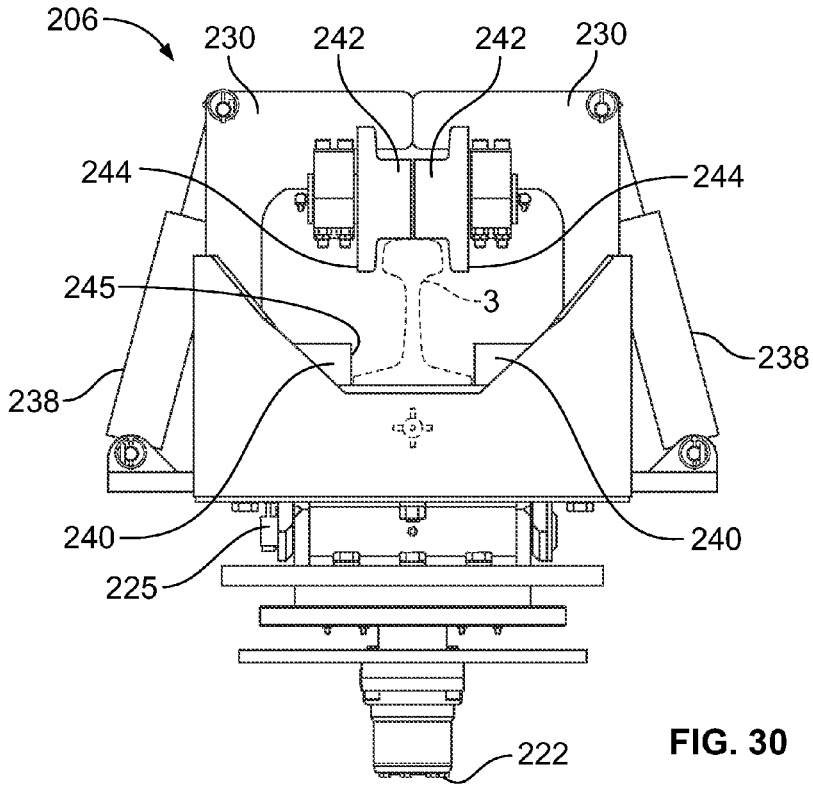
FIG. 30 is a front elevational view of the rail guide head in the closed position showing a rail supported thereon in phantom lines.
Figure 31:
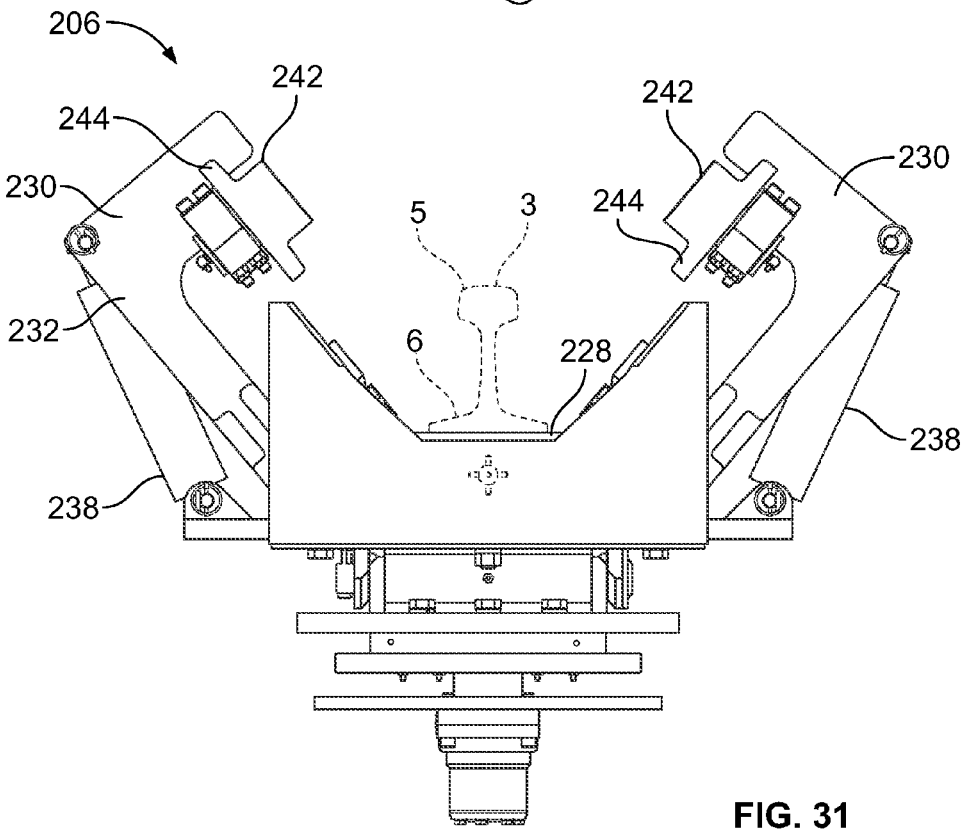
FIG. 31 is a front elevational view of the rail guide head in an open position showing a rail supported thereon in phantom lines.

As best seen in FIGS. 30 and 31, each of the threader guide boxes 206 includes a pair of jaws 230 which oppose one another and can be moved between the closed position shown in FIG. 30 and the open position shown in FIG. 31. The jaws 230 have rigid frames 232 which are mounted on horizontal shafts 234 (see FIG. 28) at their lower ends. The shafts 234 are in turn mounted to pivot bearings 236 secured to the platform 224. Each of the jaws 230 is equipped with a double acting, hydraulic actuator 238 which is pivotally connected at its lower base end to the platform 224 and at its upper or rod end to the upper portion of the jaw frame 232. When the actuators 238 are retracted as shown in FIG. 29, the jaws 230 are pivoted about the axes of shafts 234 to their open position for receiving a rail 3. Conversely, extension of the actuators 238 pivots the jaws 230 to the closed position shown in FIG. 30.

Each of the jaws 230 is provided with a pair of base rollers 240 which are mounted to rotate on the jaw frames 230. The base rollers 240 in each pair are spaced apart and are located to fit against the opposite edges of the rail base flange 6 when the jaws 230 are closed. Each jaw 230 has a pair of top rollers 242 that are applied against the top of the rail head 5 when the jaws 230 are in the closed position. The rollers 242 in each pair are mounted for rotation on the jaw frame 232 at spaced apart locations. When the jaws 230 are closed, rollers 242 on opposite jaws 230 are adjacent to one another and the rotational axes of the opposing pairs of top rollers 242 are aligned with one another.

Each top roller 242 further includes a roller flange 244 which extends to the side of a rail head 5 when the jaws 230 are closed around a rail 3. Roller flanges 244 extending on opposite sides of the rail head 5 secured in the jaws 230 extend in closely spaced relation to the sides of the rail head 5 and prevent the rail 3 from tipping over as it is being unloaded through the guide box 206.

Each threader guide box 206 provides a passage 245, when the jaws 230 are closed, that is bounded by rollers 228 at the bottom and, by rollers 242 at the top and on the sides by rollers 240 and roller flanges 244. The passage 245 is exposed or opened at the top, to accommodate receipt of a rail 3, when the jaws 230 are open. The passage 245 is closed upon closure of the jaws 230. Although it is foreseen that one or more of the rollers 228, 240 or 242 may be a driven roller used to feed the rails 3 through the boxes 206, in the embodiment shown, the rollers are not driven and simply spin freely.

Referring again to FIG. 22, rail funnel members 247 and 248 project upward from the base frame 170 of each end car 11 and 12 adjacent or inline with the turntable 208 or base for each of the rail support arm 186 and 187. The funnel members 247 and 248 project upward a height generally corresponding to the height of the rails 3 supported on the rail support stand 177. Inner surfaces 249 of each rail funnel member 247 slope inward from an end closest the rail support stand 177 toward the end closest the doors 191 and 192. The rail funnel members 247 and 248 function to keep the ends of the rails 3, particularly the outermost rails 3, in line with the area covered by the rail support arms 186 and 187 and in line with the passageway through the safety doors 191 and 192.

When a rail 3 is to be unloaded, a crane, such as crane 251 on the rail unloading machine 190, as shown in FIG. 1, with a rail clamp 253 on the end of the crane 251 is used to grasp the rail 3 and pull it toward the rail unloading machine 190 and over or above the guide box 206 on a selected support arm, which may be the first support arm 186. The guide box 206 is opened using actuators 238 before or after the rail is extended thereabove. The guide box 206 is raised and its relative position manipulated using lift actuator 216 to raise the parallelogram linkage 207, turntable actuator 210 to move the guide box 206 sideways and the guide box rotation motor 222 align the guide box passageway 245 with the rail 3. The guide box 206 is maneuvered in this manner until the guide box rail support rollers 228 are brought into contact with the rail base flange 6. The guide box 206 is then closed to support the rail 3 and prevent it from tipping over as the crane 251 is then used to pull the end of the rail 3 into one of two powered threader boxes 189 on the rail unloading machine 190.

The crane 251 is then used to position a second rail 3 below the guide box 206 on the second support arm 187, which is then raised until the guide box 206 is positioned just below the second rail 3. The guide box 206 is closed to support and guide the second rail 3 while the crane 251 is then used to pull the second rail 3 into a second powered threader box 189 on the rail unloading machine 190. The powered threader box 189 then pulls the two rails 3 off of the rail train 1 as the rail train 1 moves down the track and drops the rails along opposite sides of the side of a track for replacement of an existing rail. Although two rails 3 may be unloaded from the rail train 1 simultaneously, the system may be used to unload only one rail 3 at a time.

Figure 25:
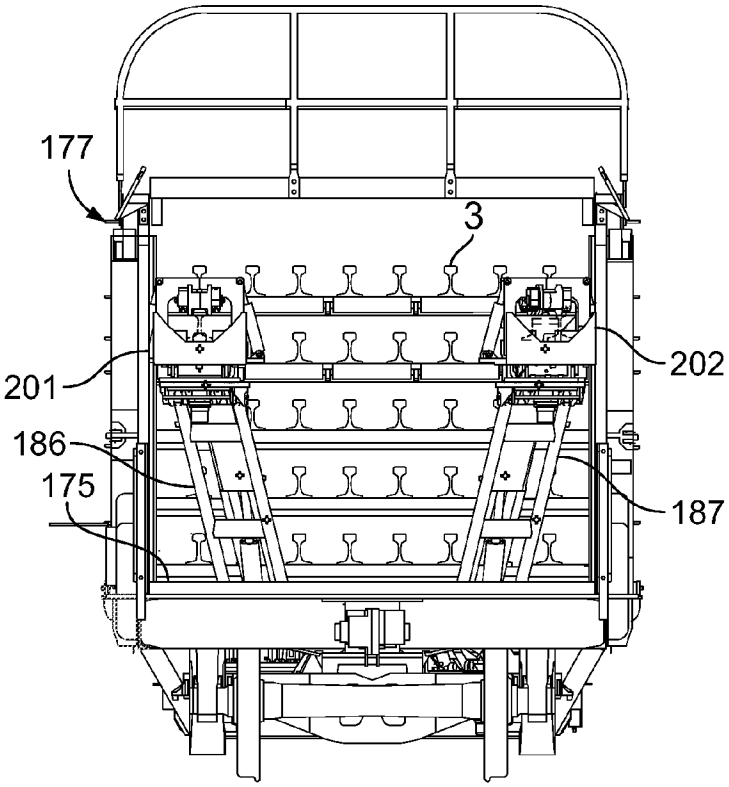
FIG. 25 is a right side end view of the end car as shown in FIG. 23 with both lift arms in a raised position.
Figure 24:
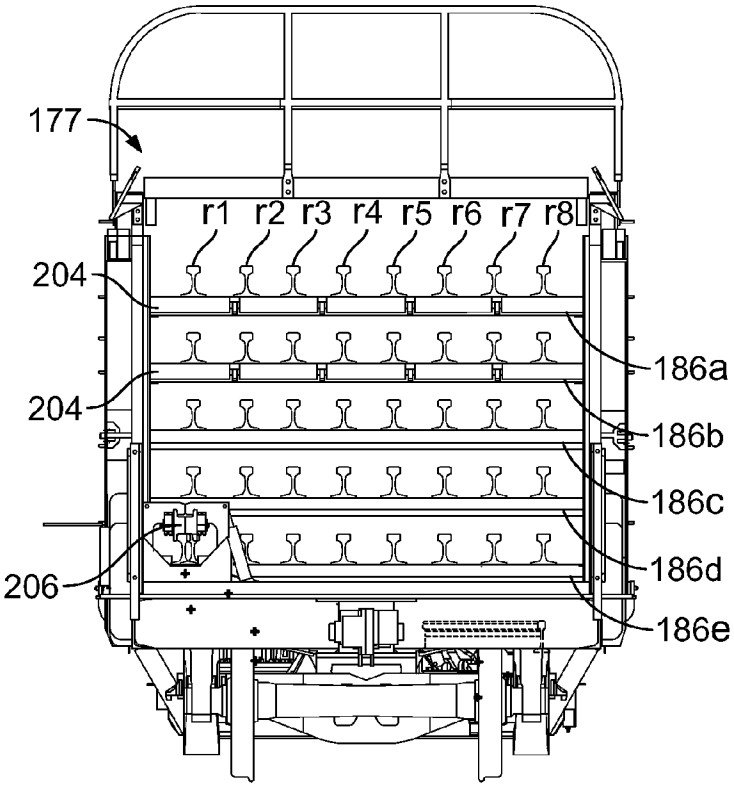
FIG. 24 is a right side end view of the end car as shown in FIG. 23 with one of two lift arms shown in a partially raised position.

With reference to the orientation of the end car 12 in FIGS. 24 and 25, rail support arm 186 is used to guide that half of the rails 3 supported on the left side of the rail support stand 177 as they are unloaded from the end car 12 and deposited on a left side of the train 1. Similarly, rail support arm 187 is used to guide that half of the rails 3 supported on the right side of the rail support stand 177 as they are unloaded from the end car 12 and positioned on a right side of the train 1. More specifically, the left support arm 186 is used to guide the four left most rails r1-r4 on each of the shelves 181*a-e* and the right support arm 187 is used to guide the four right most rails r5-r8 on each of the shelves 181*a-e*.

When two rails 3 are being unloaded generally simultaneously, the support arms 186 and 187 preferably are used to support rails that are in the same relative position of the respective sides of the rail support stand 177, starting from the top shelf 181*a* and working down to the bottom shelf 181*e*. For example, the first rail 3 removed and supported by support arm 186 may be r1 on shelf 181*a* and the first rail 3 removed and supported by support arm 187 would be r5 on shelf 181*a*. The next rails removed would then likely be r2 and r6 respectively on shelf 18*a*. Once all of the rails on one shelf 181 are removed, then the sequence is repeated for the next shelf 181. It is understood that any pattern of removal of the rails 3 may be utilized that facilitates efficient removal of the rails 3 from the train 1. Note that in FIG. 25, left and right support arms 186 and 187 are positioned to support rails 3 on different sides of the self 181*a*. In FIG. 24, the left support arm 186 is shown partially raised such that rail guide 206 is aligned with rail r1 on shelf 186*e* and the right support arm 187 is not seen as it is stored in the associated recess 188.

Figure 22:
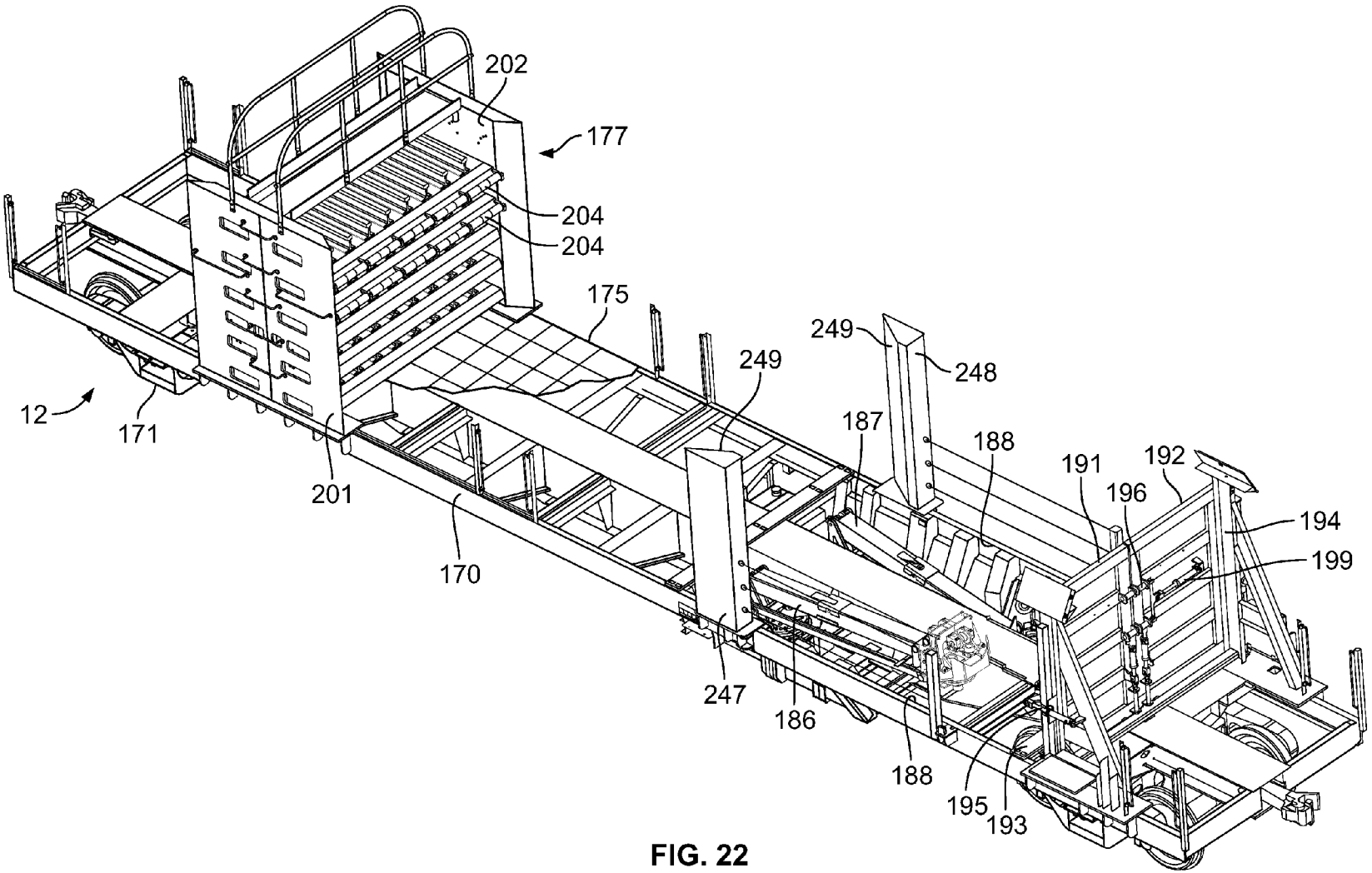
FIG. 22 is a perspective view of one of the end cars with portions of a floor grate removed to show details therebelow.
Figure 23:
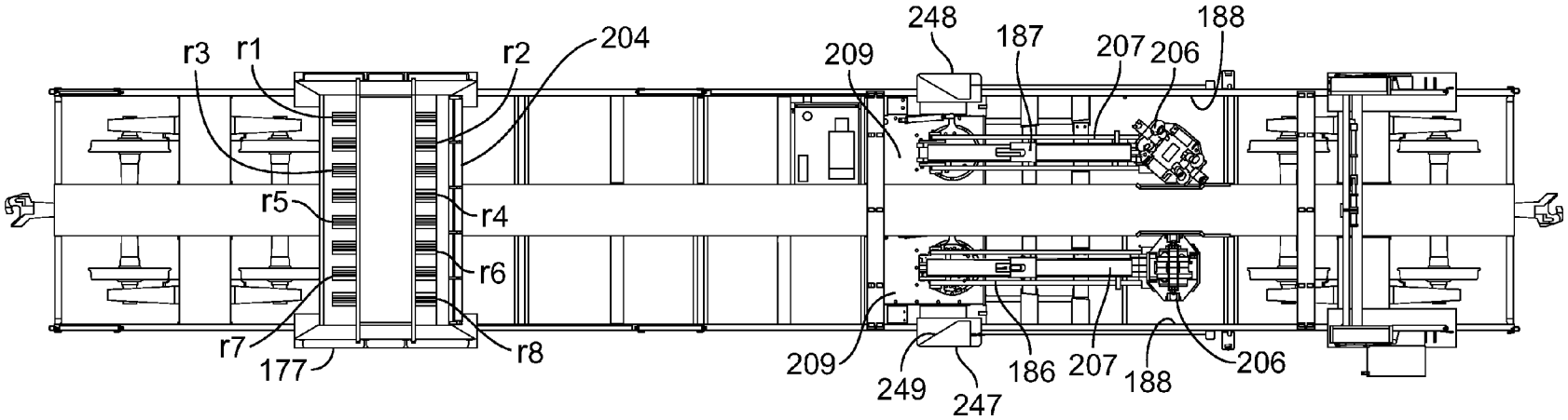
FIG. 23 is a top plan view of the end car with the floor grate removed.

After a rail 3 is removed, the guide box 206 is then lowered and positioned generally underneath where the next rail 3 will be extended for support by the guide box 206 and the process for securing the guide box 206 around the rail 3 is repeated. Referring to FIG. 22, when not in use, the rail support arms 186 and 187 are lowered into the recess 188. As seen in FIG. 23, the base turntable 208 and the base of each rail support arm 186 and 187 are positioned closer to the rail support stand 177 than the distal end of each rail support arm 186 and 187 on which the threader guide box 206 is located.

Figure 32:
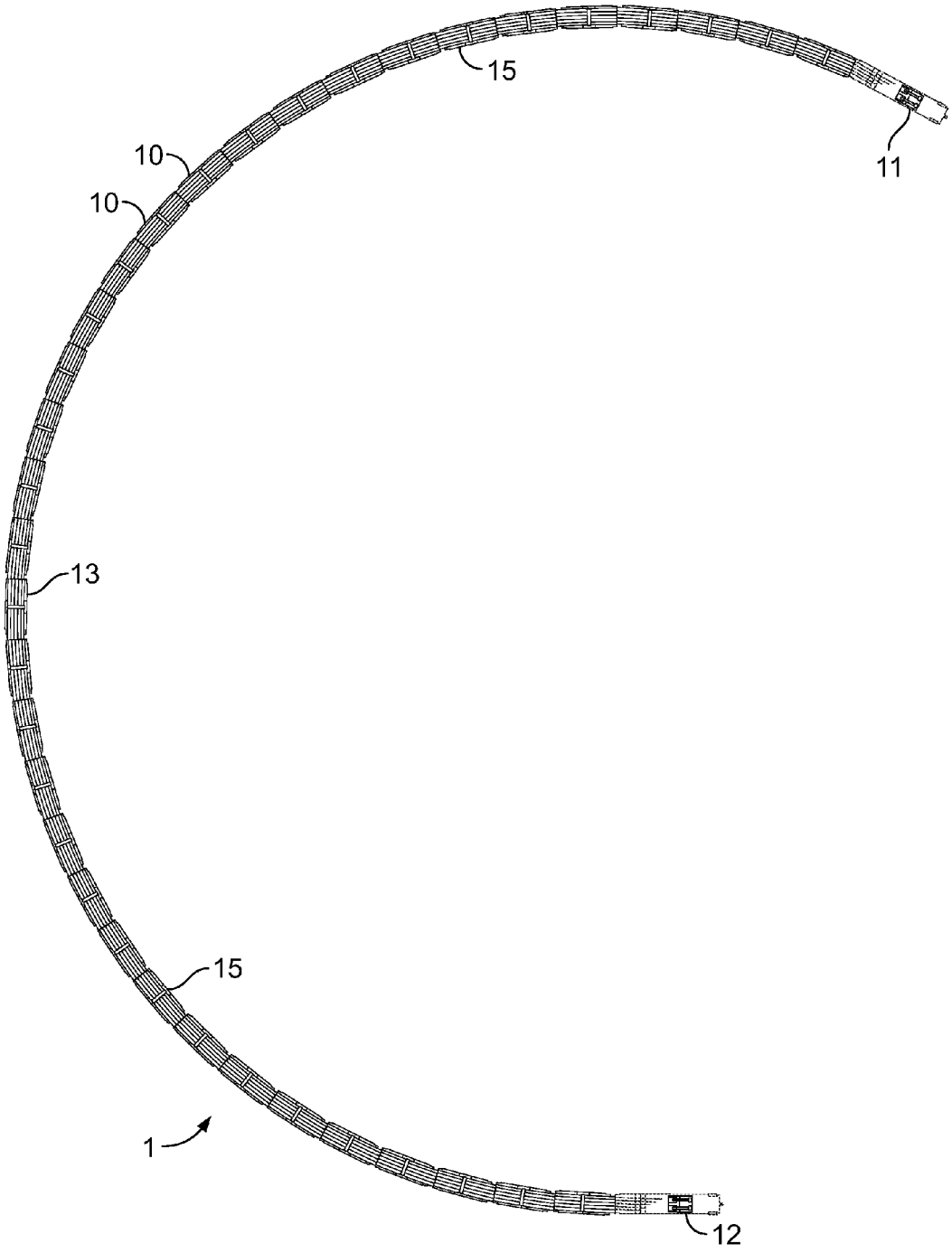
FIG. 32 is a schematic view of a rail train traveling around a curve in a track.

As seen in FIGS. 32 and 33, when the rail train 1 is loaded with rails 3, as the train 1 rounds a corner in the track 4, the pivoting of adjacent rail support cars 15, the tie down car 13 and the end cars 11 and 12 relative to one another results in the length of the outer periphery of the train growing and the inner periphery shrinking while the rails 3 supported thereon remain of a fixed length. The end cars 11 and 12 are sized and the rail support stand 177 on each tunnel car is positioned so that the ends of the rails 3 loaded on the train 1 when it is straight extend between the stand 177 and the rail support arms 186 and 187. The length of each rail 3 extending past the tunnel 177 is sufficient, such that when the train 1 traverses a relatively tight curve in the track 4, the end of the outermost rail 3, adjacent the outer periphery of the train 1, is not pulled off of the rail support shelf 181 of the tunnel car 177.

Referring to FIG. 34, it is seen that the rails 3 are connected to or restrained from lateral movement by each rail support car 15 at only a single location, preferably the center, of each rail support car 15. Because the rails 3 are only laterally restrained at one point on each support car 15 the entire rail 3 can bend relative to the rail support cars 15 and side loads are reduced.

It is to be understood that while certain forms of the present invention have been illustrated and described herein, it is not to be limited to the specific forms or arrangement of parts described and shown. As used in the claims, identification of an element with an indefinite article "a" or "an" or the phrase "at least one" is intended to cover any device assembly including one or more of the elements at issue. Similarly, references to first and second elements, or to a pair of elements, is not intended to limit the claims to such assemblies including only two of the elements, but rather is intended to cover two or more of the elements at issue. Only where limiting language such as "a single" or "only one" with reference to an element, is the language intended to be limited to one of the elements specified, or any other similarly limited number of elements.

What is claimed is:

1. A rail train for transporting a plurality of rails comprising:

a) a plurality of rail support cars, each rail support car having a single rail support stand projecting upward therefrom for supporting a plurality of ribbon rails thereon; said single rail support stand on each said rail support car extending across a width of said rail support car, centrally between ends of said rail support car and comprising the only structure on each of said rail support cars providing vertical support for and lateral restraint of the plurality of ribbon rails supported thereon;

b) adjacent rail support cars supported on a shared truck.

2. The rail train as in claim 1 wherein each of said rail support cars is approximately thirty feet long.

3. The rail train as in claim 1 wherein the spacing between rail support stands on adjacent rail support cars is approximately thirty feet.

4. The rail train as in claim 1 further comprising a clamp car having a plurality of clamps; each clamp having a clamping member and an actuator connected to a clamp base; said actuator operable to selectively advance said clamp member into and out of clamping engagement with one of the rails supported on the rail train.

5. A rail train for transporting a plurality of rails comprising:

a) a plurality of rail support cars, each rail support car having a single rail support stand projecting upward therefrom for supporting a plurality of ribbon rails thereon;

b) adjacent rail support cars supported on a shared truck; and c) a clamp car having a plurality of clamps; each clamp having a clamping member and a spring urging said clamping member into clamping engagement with one of the rails to clamp the ribbon rail to said clamp car and further including an actuator operable to selectively advance said clamp member out of clamping engagement of the rail to said clamp car and against the force of said spring.

6. An end car for a rail train comprising:

a) an end car frame;

b) a tunnel supported on the frame having a plurality of rail support shelves formed thereon in vertically spaced relationship and between tunnel sidewalls, each rail support shelf supporting a plurality of rails across its width; and c) at least one rail support arm having a rail guide assembly connected to a distal end thereof; said rail support arm connected at a base end to a support arm mount; said support arm mount pivotally connected to said end car frame to allow said support arm mount to rotate relative to said end car frame; said base end of said rail support arm pivotally connected to said support arm mount to allow said rail support arm to pivot relative to said support arm mount; wherein said support arm mount is mounted relative to said frame and said support arm is pivotal relative to said support arm mount such that no portion of said rail support arm extends above a lowermost rail support shelf of said tunnel.

7. The end car as in claim 6 wherein said rail guide assembly includes lateral supports extending proximate lateral sides of the rail supported in the rail guide assembly; said lateral supports maintaining the rail in an upright orientation.

8. The end car as in claim 6 wherein said rail guide assembly is rotatably connected to the distal end of said rail support arm.

9. An end car for a rail train comprising:

a) an end car frame;

b) a tunnel supported on the frame having a plurality of rail support shelves formed thereon in vertically spaced relationship and between tunnel sidewalls, each rail support shelf supporting a plurality of rails across its width; and c) at least one rail support arm having a rail guide assembly connected to a distal end thereof; said rail support arm connected at a base end to a support arm mount; said support arm mount pivotally connected to said end car frame to allow said support arm mount to rotate relative to said end car frame; said base end of said rail support arm pivotally connected to said support arm mount to allow said rail support arm to pivot relative to said support arm mount wherein said rail guide assembly includes a pair of opposed jaws pivotally connected to said rail guide assembly and pivotal between open and closed positions to allow access from above said rail guide assembly to a rail support chamber formed between said jaws in a closed position.

10. An end car for a rail train comprising:

a) an end car frame;

b) a tunnel supported on the frame having a plurality of rail support shelves formed thereon in vertically spaced relationship and between tunnel sidewalls, each rail support shelf supporting a plurality of rails across its width; and c) a first rail support arm having a rail guide assembly connected to a distal end thereof; said rail support arm connected at a base end to a support arm mount; said support arm mount pivotally connected to said end car frame to allow said support arm mount to rotate relative to said end car frame; said base end of said rail support arm pivotally connected to said support arm mount to allow said rail support arm to pivot relative to said support arm mount; and a second rail support arm having a second rail guide assembly connected to a distal end of said second rail support arm; said second rail support arm connected at a base end to a second support arm mount; said second support arm mount pivotally connected to said end car frame to allow said second support arm mount to rotate relative to said end car frame; said base end of said second rail support arm pivotally connected to said second support arm mount to allow said second rail support arm to pivot relative to said second support arm mount.

11. The end car as in claim 10 wherein said second rail guide assembly includes lateral supports extending proximate lateral sides of a rail supported within said second rail guide assembly; said lateral supports maintaining the rail in a generally upright orientation.

12. The end car as in claim 10 wherein said second support arm mount is mounted relative to said frame and said second support arm is pivotal relative to said second support arm mount such that no portion of said second rail support arm extends above a lowermost rail support shelf of said tunnel.

13. The end car as in claim 10 wherein said second rail guide assembly is rotatably connected to the distal end of said second rail support arm.

14. The end car as in claim 10 wherein said second rail guide assembly includes a pair of opposed jaws pivotally connected to a platform and pivotal between open and closed positions to allow access from above said second rail guide assembly to a rail support chamber between said jaws in a closed position.

15. A rail train for transporting a plurality of rails comprising:

a) plurality of rail support cars, each rail support car having a single rail support stand projecting upward therefrom for supporting a plurality of ribbon rails thereon;

b) adjacent rail support cars supported on a shared truck; and c) a clamp car having a plurality of clamps; each clamp having a clamping member and an actuator connected to a clamp base; said actuator operable to selectively advance said clamp member into clamping engagement with one of the rails to clamp the rail to said clamp car and to selectively advance said clamp member out of clamping engagement with the rail to unclamp the rail from said clamp car.

* * * * *